US008728691B2

(12) United States Patent
Tanida

(10) Patent No.: US 8,728,691 B2
(45) Date of Patent: May 20, 2014

(54) IMAGE FORMING APPARATUS

(75) Inventor: Keiichi Tanida, Osaka (JP)

(73) Assignee: Kyocera Mita Corporation (JP)

( * ) Notice: Subject to any disclaimer, the term of this patent is extended or adjusted under 35 U.S.C. 154(b) by 268 days.

(21) Appl. No.: 13/231,335

(22) Filed: Sep. 13, 2011

(65) Prior Publication Data

US 2012/0064446 A1 Mar. 15, 2012

(30) Foreign Application Priority Data

Sep. 14, 2010 (JP) ..... 2010-205685

(51) Int. Cl.
*G03G 15/08* (2006.01)
*G03G 9/00* (2006.01)

(52) U.S. Cl.
USPC ..... 430/105; 399/258; 399/281

(58) Field of Classification Search
None
See application file for complete search history.

(56) References Cited

U.S. PATENT DOCUMENTS 5,678,125 A * 10/1997 Kutsuwada et al. ..... 399/26
2003/0091922 A1 5/2003 Okado et al.
2004/0180281 A1* 9/2004 Skorokhod et al. ..... 430/111.1
2007/0065183 A1 3/2007 Tomita
2007/0238041 A1 10/2007 Kobayashi et al.
2008/0063415 A1* 3/2008 Ishida ..... 399/25
2011/0013945 A1* 1/2011 Hatakeyama et al. ..... 399/259

FOREIGN PATENT DOCUMENTS

JP 59-100471 6/1984
JP 2004-287269 10/2004
JP 2007-298977 11/2007

* cited by examiner

*Primary Examiner* — David Gray
*Assistant Examiner* — Sevan A Aydin
(74) *Attorney, Agent, or Firm* — Gerald E. Hespos; Michael J. Porco; Matthew T. Hespos

(57) ABSTRACT

An image forming apparatus includes a developer tank which houses two-component developer containing toner and carrier, and a supply unit which supplies the developer tank with supply developer containing toner and carrier, wherein, when the ratio of mass of inorganic fine particles attached to the carrier contained in the two-component developer to mass of the carrier contained in the two-component developer is A, and when the ratio of mass of inorganic fine particles attached to the carrier contained in the supply developer to mass of the carrier contained in the supply developer is B, the following Formula (1) is satisfied:

$$0.7<B/A<0.96 \quad (1).$$

3 Claims, 4 Drawing Sheets

IMAGE FORMING APPARATUS

BACKGROUND OF THE INVENTION

1. Field of the Invention

The present disclosure relates to an image forming apparatus.

2. Description of the Related Art

An image forming apparatus that uses an electrographic system such as a copier, printer, a facsimile device, or a multi-functional peripheral thereof forms a toner image by using a developing device to supply toner containing in developer to the surface of a photoreceptor on which an electrostatic latent image based on image data is formed. The toner image formed on the photoreceptor is subsequently transferred to a sheet by using a transfer device or the like. Then, by using a fixing device to pressurize and heat the toner image that was transferred on the sheet, the toner image is fixed to the sheet and image based on the image data is thereby formed on the sheet.

This kind of image forming apparatus is demanded of faster speed and higher quality, and lower printing cost; for instance, the reduction in printing cost that is required per single sheet of paper. In order to achieve the reduction of printing cost, considered may be achieving the longer service life of consumable supplies and reduction of consumable supplies cost. As the foregoing consumable supplies cost, it is known that sophisticated members such as the photoreceptor and developer account for most of the cost.

Foremost, as the photoreceptor that is provided to an electrographic image forming apparatus, there is an organic photoreceptor including a photosensitive layer containing, as its main component, organic materials such as binder resin, a charge generation agent and a charge transfer agent, or an inorganic photoreceptor including a photosensitive layer made of inorganic materials such as amorphous silicon or selenium. In order to achieve the longer service life of the photoreceptor, in the case of an organic photoreceptor, measures for preventing the phenomenon where the photosensitive layer is scraped; that is, drum scraping, are being taken by providing a protective layer on the surface of the photosensitive layer. Moreover, in the case of an inorganic photoreceptor; for example, an amorphous silicon photoreceptor in which the photosensitive layer is amorphous silicon, the abrasion resistance of the photosensitive layer is sufficiently high, and it is possible to sufficiently inhibit the scraping of the photosensitive layer. Based on the above, the longer service life of the amorphous silicon photoreceptor has been achieved, and the life of the photoreceptor is now equal to or longer than the life of the image forming apparatus as a machine; that is, the so-called machine life. The longer service life of the photoreceptor is beneficial for reducing the consumable supplies cost.

Moreover, as the developer that is used in an electrographic image forming apparatus, there is mono-component developer that contains toner but does not contain carrier, or two-component developer that contains toner and carrier. The developing device that is provided in an electrographic image forming apparatus agitates the developer in advance and charges the toner prior to supplying the toner to the surface of the photoreceptor. Here, if the two-component developer is used as the developer, the toner is agitated under the existence of the carrier when the developer is agitated. Meanwhile, if the mono-component developer is used as the developer, only the toner is agitated. Accordingly, the developing device using the two-component developer can ensure the charged amount of the toner more easily in comparison to the developing device using the mono-component developer.

In addition, under normal circumstances, the developing device using the two-component developer; for example, a two-component developing device foremost causes the two-component developer to come in contact with the development roller that is disposed opposite to the photoreceptor upon performing image formation. Consequently, since a magnet is included in the development roller, the carrier lies in the shape of brushes on the development roller. Since the toner is attached on the carrier, a magnetic brush made from the two-component developer is formed. By causing the magnetic brush to come in contact with or be in close proximity to the photoreceptor, the toner is supplied to the surface of the photoreceptor on which the electrostatic latent image based on image data was formed, and the toner image based on the image data is thereby formed. As described above, since the toner is used when the two-component developing device performs image formation, new toner is supplied (replenished) to perform image formation over a long period of time. Meanwhile, since the carrier is not used, the same carrier is repeatedly used even when image formation is performed over a long period of time.

In the case of the developing device using the two-component developer, as described above, in comparison to the developing device using the mono-component developer, it is easier to ensure the charged amount of the toner and obtain a high quality image as the formed image. Nevertheless, when the developing device using the two-component developer performs image formation over a long period of time, the carrier will be repeatedly used for a long period of time, and it is known that the performance of the carrier, such as charge application performance, will deteriorate. Consequently, it is known that the charged amount of the toner will decrease, which tends to cause fogging and the like, and becomes difficult to form a favorable image.

SUMMARY OF THE INVENTION

Thus, an object of this disclosure is to provide an image forming apparatus in which the charged amount of the toner will not decrease even when image formation is performed over a long period of time, and capable of forming high quality images by inhibiting the generation of fogging and the like.

One aspect of the present disclosure is an image forming apparatus including a developer tank which houses two-component developer containing toner and carrier, and a supply unit which supplies the developer tank with supply developer containing toner and carrier to the developer tank, wherein, when the ratio of mass of inorganic fine particles attached to the carrier contained in the two-component developer to mass of the carrier contained in the two-component developer is A, and when the ratio of mass of inorganic fine particles attached to the carrier contained in the supply developer to mass of the carrier contained in the supply developer is B, the following Formula (1) is satisfied:

$$0.7<B/A<0.96 \quad (1).$$

DETAILED DESCRIPTION OF THE PREFERRED EMBODIMENTS

Figure 1:
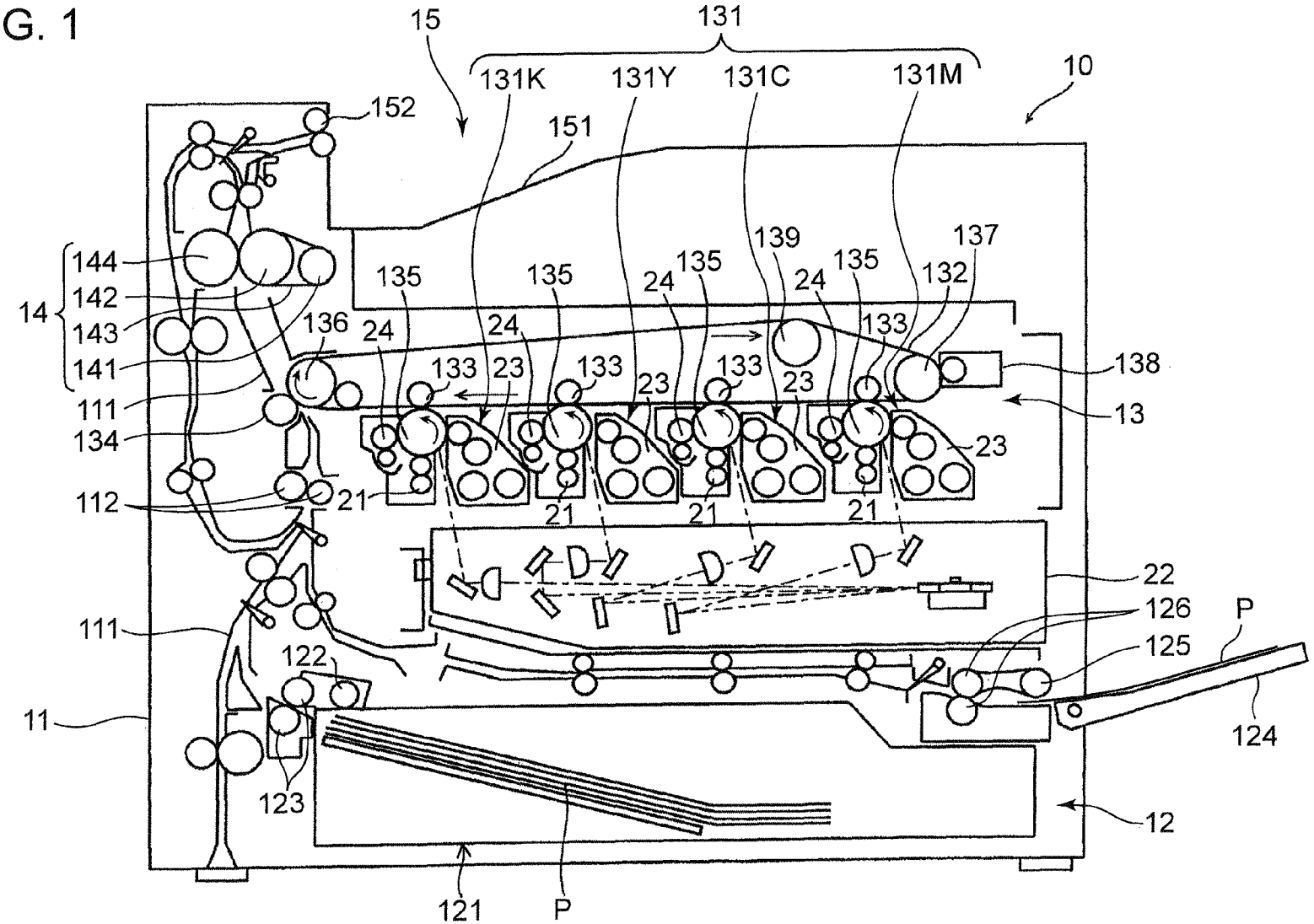
FIG. 1 is a schematic diagram showing the overall configuration of the image forming apparatus according to an embodiment of the disclosure.

When image formation is performed over a long period of time in a developing device using two-component developer, the cause of deterioration of the performance of the carrier, such as the charge application performance, was speculated to be as follows.

The reason why the carrier performance is considered to deteriorate is because, when the carrier is repeatedly used over a long period of time, a phenomenon known as carrier spent where the toner components such as toner mother particles and external additives become attached to the carrier occurs. In order to inhibit this kind of deterioration of the carrier performance, considered may be using resin coated carrier in which the carrier surface is coated with fluorine-based resin or the like. As a result, it is considered that it is possible to inhibit the toner components from becoming attached to the carrier surface. Nevertheless, even when two-component developer containing this kind of resin coated carrier is used; for instance, when continuously forming images of a high printing ratio, there were cases where the toner components such as the external additives would become attached to the carrier surface as a result of the resin coated on the carrier surface falling off, and the deterioration in the carrier performance, such as the charge application performance, could not be sufficiently inhibited. Thus, there were cases where it was not possible to form high quality images over a long period of time.

Thus, attention was given to using a developing device; that is, a developing device of a so-called trickle developing system, that supplies supply developer containing toner and carrier, rather than just toner, as the development device using the two-component developer. As the developing device of a trickle developing system, for instance, there is the following developing device.

Specifically, there is a developing device for electrographic including an agitation means for agitating the carrier and the toner, and a development roller for supplying the developer that was agitated by the agitation means to the photoreceptor, wherein carrier supply device and a toner device are provided separately or integrally above the agitation means, and a developer overflow part is provided on the side wall of the developing device housing. As a result of using this kind of developing device for electrographic, it is expected that the development characteristics of the developer within the device can be maintained at a constant level and that the operation for replacing the developer can be eliminated by supplying the carrier and the toner in small quantities at a time and causing the developer in the developing device to spill from the developer overflow part.

Meanwhile, in order to form high quality images with an image forming apparatus using an electrographic system, considered may be a case of using toner having a relatively small particle diameter. When toner having this kind of small particle diameter is used, it is expected that the formed image will be of a high resolution and with superior color tone.

Nevertheless, when toner having a small particle diameter is simply used in a developing device of the foregoing trickle developing system, there were problems in that fogging and the like caused by the toner of the developer would occur, and it becomes difficult to form favorable images. This was speculated to be due to the following reasons.

In the case of toner having a small particle diameter, the content of the external additives to be externally added to the toner mother particles is high in order to ensure the fluidity and the like. Thus, it is considered that the external additives contained in the toner are preferentially transferred to the newly supplied carrier. Consequently, it is considered that the carrier performance such as the charge application performance will change, and, as a result of the charged amount of the toner also being changed, fogging and the like tend to occur in the formed image.

Thus, in order to resolve this problem, attention was given to using carrier to which inorganic fine particles were attached, rather than only using carrier, as the carrier to be supplied. As an image formation method using this kind of carrier, for example, the following method can be used.

Specifically, in an image formation method using a trickle developing system which supplies a mixture of toner and carrier in a developing unit, the toner is toner having a volume median diameter of 3 to 8 μm as a result of first inorganic fine particles being attached to coloring particles, and the carrier is carrier having a mass average particle diameter (D4) of 20 to 40 μm as a result of second inorganic fine particles being attached to the magnetic particles, and, among the elements configuring the first inorganic fine particles which are attached to the toner, when the elements that are common with the elements configuring the second inorganic fine particles which are attached to the carrier are considered elements (A), the area ratio of the elements (A) on the carrier surface that is measured with an X-ray analyzer is 0.5 to 3.0 area percent. According to this method, in a trickle developing system which uses toner having a small diameter, even when image formation is continued under conditions where the toner consumption is high, it is expected that the change in the toner charged amount is minimal, and images that are free of image fogging and image irregularities can be obtained.

Nevertheless, even in cases of employing this kind of method, there were cases where favorable images could not be formed. Specifically, when low density images were continuously printed at the initial stage of image formation, there were cases where favorable images could not be formed. In the foregoing case, the toner and the carrier are mixed over a long period of time in a toner container for supplying the toner and the carrier. Thus, a large quantity of the external additives contained in the toner is transferred to the carrier in the toner container. Thus, it is considered that a considerable difference arises in the performance such as the charge application performance between the carrier in the toner container to be supplied to the developing device and the carrier which was previously stored in the developing device. This is considered to be the reason why favorable images could not be formed.

Thus, as a result of focusing attention on the foregoing circumstances and conducting intense study regarding the various conditions, the present disclosure as described below was conceived.

The image forming apparatus according to an embodiment of the present disclosure is now explained in detail with reference to the appended drawings. As the image forming apparatus, the image forming apparatus of a tandem system is taken as an example in the ensuing explanation, but there is no particular limitation so as long as it is an image forming apparatus using an electrographic system, and is not limited to a tandem image forming apparatus. Moreover, although a color printer is explained as an example of a type of image forming apparatus, for instance, this may also be a copier, a facsimile device, or a multi-functional peripheral, and is not limited to a color printer.

FIG. 1 is a schematic diagram showing the overall configuration of the image forming apparatus 10 according to an embodiment of the present disclosure. As the image forming apparatus 10 according to an embodiment of the present disclosure, the image forming apparatus (color printer) 10 of a so-called tandem system which performs image formation processing based on image information that is sent from an external device such as a computer is taken as an example in the ensuring explanation.

This image forming apparatus 10 is provided with a paper feeding unit 12 for feeding sheets P, an image forming part 13 which forms a toner image based on image information on the sheet P that was fed from the paper feeding unit 12, and a fixing unit 14 which performs fixation treatment for fixing, on the sheet P, the unfixed toner image that was formed on the sheet P by the image forming part 13, and these are all internally mounted in a box-shaped apparatus main body 11 as shown in FIG. 1. In addition, a paper receiving unit 15, to which the sheet P that was subject to the fixation treatment by the fixing unit 14 is discharged, is formed at the upper part of the apparatus main body 11.

An operation panel not shown for inputting the output conditions of the sheet P is provided to an appropriate location at the upper surface of the apparatus main body 11. This operation panel is provided with a power key, and various keys for inputting the output conditions.

Moreover, a sheet conveying path 111 extending in the vertical direction is formed within the apparatus main body 11 at a position that is more leftward than the image forming part 13 shown in FIG. 1. Conveying roller pairs 112 are provided at an appropriate location on the sheet conveying path 111. The sheet conveying path 111 is formed such that the sheet P is conveyed from the paper feeding unit 12 to the paper receiving unit 15 by the conveying roller pairs 112, and the sheet P that is being conveyed passes by the transfer part of the image forming part 13 and the fixing unit 14.

The paper feeding unit 12 includes a paper feed tray 121, a pickup roller 122, and a paper feed roller pair 123. The paper feed tray 121 can be inserted removably in the apparatus main body 11 at a position that is lower than the image forming part 13, and stores a sheet bundle in which a plurality of sheets P are stacked. The pickup roller 122 is provided at an upward position on the upstream side in the conveying direction of the sheet P of the paper feed tray 121, specifically, at the upward left position shown in FIG. 1, and picks up, one by one, the sheet P on the uppermost surface of the sheet bundle stored in the paper feed tray 121. The paper feed roller pair 123 sends the sheet P that was picked up by the pickup roller 122 to the sheet conveying path 111. Based on each of the foregoing operations, the paper feeding unit 12 feeds the sheet P toward the image forming part 13.

Moreover, the paper feeding unit 12 additionally includes a manual bypass tray 124, a pickup roller 125, and a paper feed roller pair 126 which are mounted on the right side face of the apparatus main body 11 shown in FIG. 1. The manual bypass tray 124 is used for supplying the sheet P toward the image forming part 13 by a manual operation. The manual bypass tray 124 can be housed in the side face of the apparatus main body 11, and, upon manually feeding the sheet P, is pulled out from the side face of the apparatus main body 11 and used for manually feeding of paper as shown in FIG. 1. The pickup roller 125 picks up the sheet P that is placed on the manual bypass tray 124. The sheet P that was picked up by the pickup roller 125 is sent to the sheet conveying path 111 by the paper feed roller pair 126. Based on each of the foregoing operations, the paper feeding unit 12 feeds the sheet P toward the image forming part 13.

The image forming part 13 is used for forming an image such as a color image on the sheet P that was fed from the paper feeding unit 12 by predetermined image processing. The image forming part 13 includes a plurality of image forming units 131, an intermediate transfer belt (intermediate transfer body) 132, primary transfer rollers 133, and a secondary transfer roller 134.

As the image forming unit 131, in the embodiment, provided are a magenta unit 131M which uses magenta (M) color developer, a cyan unit 131C which uses cyan (C) color developer, a yellow unit 131Y which uses yellow (Y) color developer, and a black unit 131K which uses black (K) color developer which are sequentially arranged from the upstream side to the downstream side (from right to left in FIG. 1) in the rotating direction of the intermediate transfer belt 132. Each unit 131 includes a photoreceptor drum 135 as the image carrier, forms a toner image corresponding to each color based on image formation on the photoreceptor drum 135, and performs the primary transfer thereof to the intermediate transfer belt 132.

Moreover, the image forming unit 131 is disposed so that the photoreceptor drum 135 can rotate at its center position in the arrow (arrow A in FIG. 2) direction. In addition, when the transfer (primary transfer) position by the primary transfer roller 133 is set to be on the most upstream side in the rotating direction of the photoreceptor drum 135, a cleaning device 24, a charging device 21, an exposure device 22, and a developing device 23 are disposed therefrom in order around the photoreceptor drum 135 toward the downstream side.

The photoreceptor drum 135 is used for forming a toner image corresponding to the respective colors based on image information on its peripheral surface by the charging process, exposure process, development process, neutralization process and so on described later. There is no particular limitation in the photoreceptor drum 135 so as long as it is a photoreceptor drum that can be provided in the image forming apparatus. For example, an organic photoreceptor (OPC) drum or an amorphous silicon (a-Si) photoreceptor drum can be used.

The charging device 21 is used for charging the peripheral surface of the photoreceptor drum 135 that is rotating in the arrow direction. There is no particular limitation in the charging device 21 so as long as it is a charging device that can be provided in the image forming apparatus. Specifically, for example, used may be a charging device of a contact discharge system which includes a charging roller and charges the peripheral surface of the photoreceptor drum by applying a predetermined charging bias voltage to the charging roller, or a corotron-type or a scorotron-type charging device using a non-contact discharge system.

The exposure device 22 is used for irradiating a laser beam or LED light based on the image information to the peripheral surface of the photoreceptor drum 135 in which its peripheral surface was charged by the charging device 21, and forming an electrostatic latent image based on the image information on the peripheral surface of the photoreceptor drum 135. There is no particular limitation in the exposure device 22 so as long as it is an exposure device that can be provided in an image forming apparatus. Specifically, for example, used may be an LED head unit or a laser scanning unit (LSU).

The developing device 23 is used for developing the electrostatic latent image formed on the peripheral surface of the photoreceptor drum 135 into a toner image. Note that the configuration of the developing device 23 will be described later.

The cleaning device 24 is used for removing the toner remaining on the peripheral surface of the photoreceptor drum 135 after the primary transfer roller 133 transferred the toner image on the peripheral surface of the photoreceptor drum 135 to the intermediate transfer belt 132 (primary transfer). The peripheral surface of the photoreceptor drum 135 from which the toner remaining after the primary transfer was removed by the cleaning device 24 heads toward the charging position by the charging device 21 for new image formation processing. Moreover, the waste toner that was removed by the cleaning device 24 passes through a predetermined route and is recovered to and stored in a toner recovery bottle not shown.

Moreover, prior to removing the toner by the cleaning device 24, it is also possible to neutralize the peripheral surface of the photoreceptor drum 135 using a neutralizing device not shown. Consequently, the cleaning device 24 can appropriately remove the toner remaining on the peripheral surface of the photoreceptor drum 135 after the primary transfer.

The intermediate transfer belt 132 is subject to the transfer (primary transfer) of the toner image based on image information on its peripheral surface (contact surface) from a plurality of image forming units 131. In other words, in the embodiment, the intermediate transfer belt 132 is a transfer object that is sandwiched between the photoreceptor drum 135 and the primary transfer rollers 133 and which has a peripheral surface to which the toner image is transferred from photoreceptor drums 135.

Moreover, the intermediate transfer belt 132 is an endless belt-shaped rotating body and is placed across the drive roller 136, the belt support roller 137, and the tension roller 139 so that its peripheral surface side comes in contact with the peripheral surface of the respective photoreceptors 135. Moreover, the intermediate transfer belt 132 is configured to perform endless rotation by the rotational drive of the drive roller 136 in a state of being pressed against the respective photoreceptor drums 135 by the respective primary transfer rollers 133 which are disposed at a position opposite to the respective photoreceptor drums 135 via the intermediate transfer belt 132. The drive roller 136 is rotationally driven by a drive source such as a stepping motor, and supplies driving force for causing the intermediate transfer belt 132 to engage in endless rotation. The belt support roller 137 and the tension roller 139 are provided in a rotatable manner, and are driven rollers which are driven and rotated according to the endless rotation of the intermediate transfer belt 132 by the drive roller 136. These driven rollers 137, 139 are driven and rotated via the intermediate transfer belt 132 according to the main drive of the drive roller 136, and support the intermediate transfer belt 132. In addition, the tension roller 139 applies tension (tensile force) to the intermediate transfer belt so that the intermediate transfer belt 132 does not come loose. The tension roller 139 generates the tension by applying pressing force to the intermediate transfer belt 132 from the back side (inner peripheral side) of the intermediate transfer belt 132 toward the surface (outer peripheral side) by being biased, for example, by a biasing member such as a spring or the like.

The primary transfer rollers 133 are used for performing the primary transfer of the toner image formed on the photoreceptor drums 135 to the intermediate transfer belt 132. In other words, in the embodiment, the primary transfer roller 133 is a transfer part which sandwiches the intermediate transfer belt 132 together with the photoreceptor drum 135, and performs the primary transfer of the toner image on the peripheral surface of the photoreceptor drum 135 to the intermediate transfer belt 132.

Moreover, each of the primary transfer rollers 133 is disposed at a position opposite to the respective photoreceptor drums 135 via the intermediate transfer belt 132. The primary transfer roller 133 is provided for the respective photoreceptor drums 135. Moreover, the primary transfer roller 133 is driven to rotate by the endless rotation of the intermediate transfer belt 132 while being in contact with the intermediate transfer belt 132. Here, by applying a primary transfer bias voltage having a reverse polarity relative to the charging polarity of the toner to the respective primary transfer rollers 133, the toner image formed on the respective photoreceptor drums 135 is subject to primary transfer to the intermediate transfer belt 132 between the respective photoreceptor drums 135 and the respective corresponding primary transfer rollers 133. Consequently, the toner image formed on the respective photoreceptor drums 135 is sequentially subject to primary transfer, in an overlapped manner, on the intermediate transfer belt 132 that is rotating in the arrow direction (clockwise direction in FIG. 1).

The secondary transfer roller 134 is used for transferring (secondary transfer) the toner image on the intermediate transfer belt 132 to the sheet P that was fed from the paper feeding unit 12. In other words, in the present embodiment, the secondary transfer roller 134 is a secondary transfer part which forms a nip part by coming in contact with the peripheral surface of the intermediate transfer belt 132, and performs the secondary transfer of the toner image on the peripheral surface of the intermediate transfer belt 132 to the sheet P as the recording medium that passed through the nip part.

Moreover, the secondary transfer roller 134 is disposed at a position opposite to the drive roller 136 via the intermediate transfer belt 132. Moreover, the secondary transfer roller 134 is driven to rotate by the endless rotation of the intermediate transfer belt 132 while being in contact with the intermediate transfer belt 132. Here, the toner image on the peripheral surface of the intermediate transfer belt 132 is subject to secondary transfer to the sheet P that was fed from the paper feeding unit 12 between the secondary transfer roller 134 and the drive roller 136. Consequently, the toner image based on image information is transferred onto the sheet P in an unfixed state.

Moreover, the image forming part 13 additionally includes a belt cleaning device 138 disposed downstream of the secondary transfer position and upstream of the primary transfer position in the rotating direction than of the intermediate transfer belt 132. The belt cleaning device 138 is used for cleaning the intermediate transfer belt 132 after the secondary transfer by removing the toner remaining on the peripheral surface of the intermediate transfer belt 132. The peripheral surface of the intermediate transfer belt 132 from which the toner remaining after the primary transfer was removed by the belt cleaning device 138 heads toward the primary transfer position for new image formation processing. Moreover, the waste toner that was removed by the belt cleaning device 138 passes through a predetermined route and is recovered to and stored in a toner recovery bottle not shown.

The fixing unit 14 is used for performing fixation treatment to the toner image on the sheet P that was subject to secondary transfer by the secondary transfer roller 134. The fixing unit 14 includes a heating roller 141 internally including a conductive heating unit as a heat source, a fixation roller 142 disposed opposite to the heating roller 141, a fixation belt 143 that is wrapped around the fixation roller 142 and the heating roller 141, and a pressure roller 144 disposed opposite to the fixation roller 142 via the fixation belt 143.

The sheet P that is supplied to the fixing unit 14 is heated and pressurized by passing through the fixation nip part that is formed between the fixation belt 143 and the pressure roller 144. Consequently, the toner image that was subject to secondary transfer to the sheet P by the secondary transfer roller 134 is fixed to the sheet P. The sheet P that was subject to fixation treatment is ejected to the discharge tray 151 of the paper receiving unit 15 provided at the apex of the apparatus main body 11 via the sheet conveying path 111 provided in an extending manner from the upper part of the fixing unit 14.

The paper receiving unit 15 is formed by the apex of the apparatus main body 11 being hollowed, and the discharge tray 151 for receiving the ejected sheet P is formed at the bottom part of the foregoing concave part.

Figure 2:
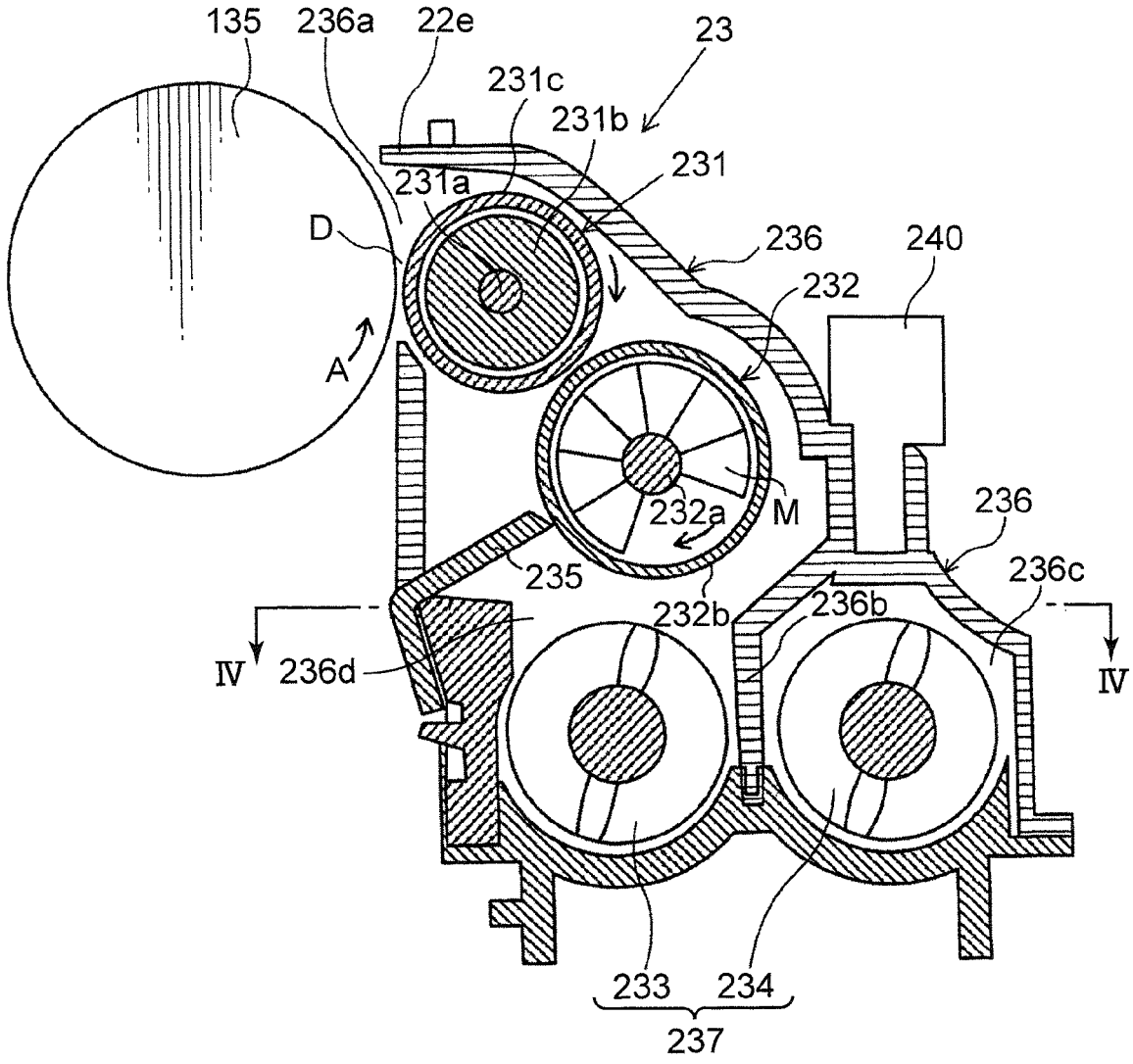
FIG. 2 is a schematic cross section showing an enlarged view of the developing device provided in the image forming apparatus and the periphery thereof according to an embodiment of the present disclosure.
Figure 3:
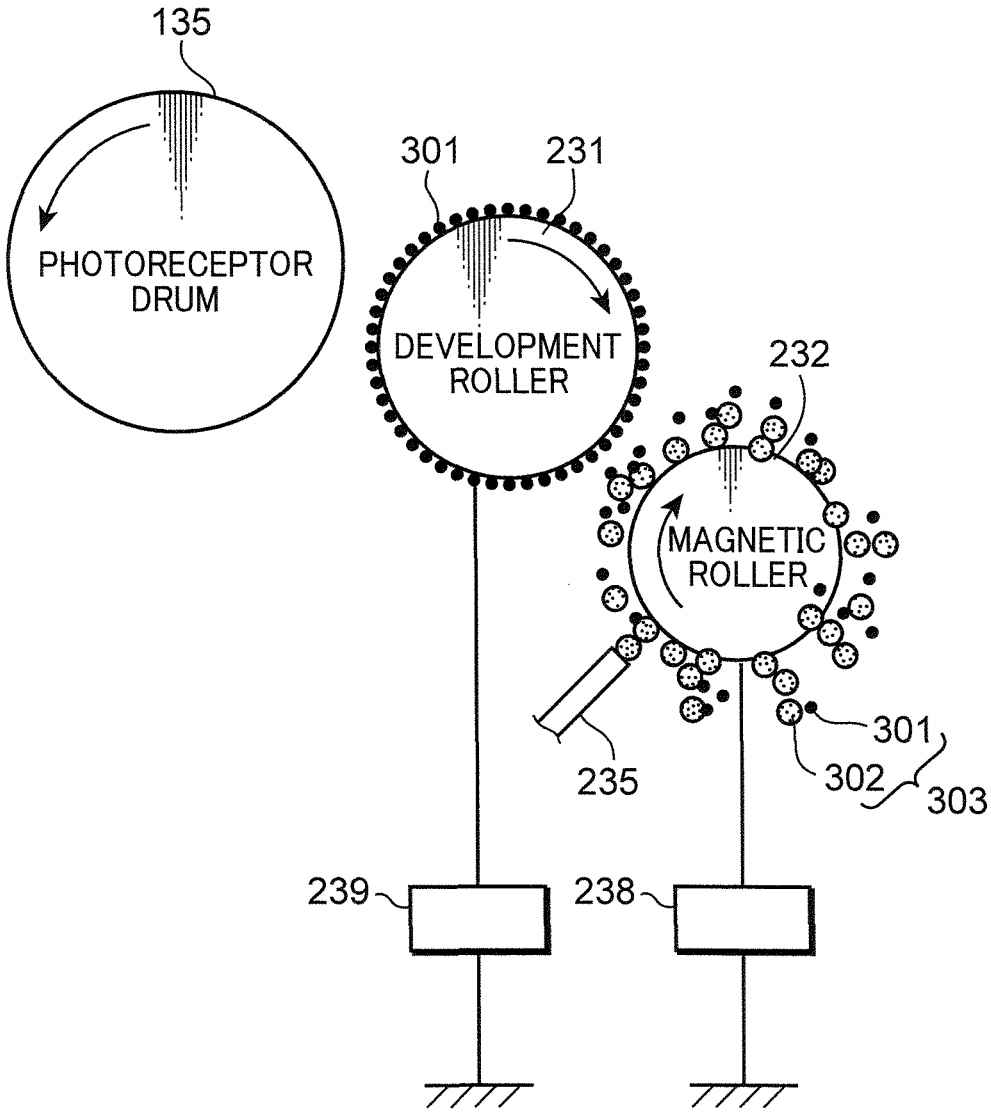
FIG. 3 is a conceptual diagram explaining the developing process by the developing device provided in the image forming apparatus according to an embodiment of the present disclosure.

The developing device 23 is now explained with reference to FIG. 2 and FIG. 3. Note that FIG. 2 is a schematic cross section showing an enlarged view of the developing device 23 provided in the image forming apparatus 10 and the periphery thereof according to an embodiment of the present disclosure. Moreover, FIG. 3 is a conceptual diagram explaining the developing process by the developing device 23 provided in the image forming apparatus 10 according to an embodiment of the present disclosure, and the positional relationship of the photoreceptor drum 135, the development roller 231, the magnetic roller 232, and the regulation blade 235 is different from FIG. 2.

The developing device 23 is, as described above, used for developing the electrostatic latent image formed on the peripheral surface of the photoreceptor drum 135 into a toner image. The developing device 23 is provided with, as shown in FIG. 2, a development roller 231, a magnetic roller 232, and an agitation/conveying members 237 which are mounted inside the development container 236. As shown in FIG. 3, a development bias voltage application unit 239 is connected to the development roller 231, and a toner supply bias voltage application unit 238 is connected to the magnetic roller 232. Moreover, the developing device 23 includes a developer supply container 240 for supplying the supply developer containing the toner 301 and the carrier 302 through the developer supply port 236*g* described later.

The developer container 236 configures the outer profile of the developing device 23, and is a developer tank which houses the two-component developer containing the carrier and the toner. The developer container (developer tank) 236 is formed with an opening 236*a* for exposing the development roller 231 toward the photoreceptor drum 135. The developer container 236 is additionally formed, at the lower part thereof, with a first conveying path 236*c* and a second conveying path 236*d* which are partitioned by a partitioning part 236*b*. Moreover, the developer container 236 rotatably supports the development roller 231, the magnetic roller 232, and the agitation/conveying member 237.

The development roller 231 faces the photoreceptor drum 135 and the magnetic roller 232, respectively, and is disposed so that the opposing peripheral surfaces thereof are separated in an adjacent state. In other words, the development roller 231 and the photoreceptor drum 135 are disposed so that their respective peripheral surfaces are separated in an adjacent state, and form the development region D for supplying the toner to the photoreceptor drum 135. Moreover, both the development roller 231 and the magnetic roller 232 are disposed so that their respective peripheral surfaces are separated in an adjacent state.

The magnetic roller 232 carries the two-component developer close to the development roller 231 by bearing the two-component developer containing the toner on its peripheral surface with a magnetic pole member M fixed and disposed internally, and rotating its peripheral surface in the foregoing state. The magnetic roller 232 thereby supplies the toner including in the two-component developer to the development roller 231.

The development roller 231 carries the toner close to the photoreceptor drum 135 by bearing the toner supplied from the magnetic roller 232 on its peripheral surface, and rotating its peripheral surface in the foregoing state. Consequently, the electrostatic latent image that was preliminarily formed on the peripheral surface of the photoreceptor drum 135 is thereby visualized (developed) as a toner image.

The agitation/conveying member 237 is configured from a first agitation/conveying member (agitation mixer) 234 and a second agitation/conveying member (paddle mixer) 233. The first agitation/conveying member 234 is provided in the first conveying path 236*c*, and the second agitation/conveying member 233 is provided in the second conveying path 236*d*.

The paddle mixer 233 and the agitation mixer 234 have spiral blades and charge the toner contained in the two-component developer by conveying and agitating the two-component developer in mutually reverse directions. In addition, the paddle mixer 233 supplies the two-component developer containing the charged toner to the magnetic roller 232.

The regulation blade 235 is disposed so that one end thereof faces the peripheral surface of the magnetic roller 232, and is used for restricting the thickness of the two-component developer that is bourn on the magnetic roller 232.

The magnetic roller 232 includes a roller axis 232*a*, a magnetic pole member M, and a nonmagnetic sleeve 232*b* made from a nonmagnetic material. The magnetic roller 232 bears the developer that was supplied by the paddle mixer 233 of the agitation/conveying member 237 as described above, and supplies the toner from the supported developer to the development roller 231. The magnetic pole member M is configured by a plurality of magnets with different magnetic poles on the outer peripheral part formed in a fan-shaped cross section being disposed alternately, and is fixed to the roller axis 232*a* via an adhesive or the like. The roller axis 232*a* is supported non-rotatably by the developer container 236 within the nonmagnetic sleeve 232*b* by providing a predetermined interval between the magnetic pole member M and the nonmagnetic sleeve 232*b*. The nonmagnetic sleeve 232*b* rotates in the arrow direction (same direction as the development roller 231; clockwise direction in FIG. 2) by a drive mechanism configured from a motor, a gear wheel and the like not shown.

The development roller 231 is configured by including a fixed axis 231*a*, a magnetic pole member 231*b*, and a development sleeve 231*c* formed cylindrically and made of a nonmagnetic metal material. The fixed axis 231*a* is supported non-rotatably by the developer container 236. The magnetic pole member 231*b* is fixed to the fixed axis 231*a* using an adhesive or the like. The development sleeve 231*c* is rotatably provided to the fixed axis 231*a* by providing a predetermined interval between the magnetic pole member 231*b* and the development sleeve 231*c*. The development sleeve 231*c* rotates in the arrow direction (clockwise direction in FIG. 2) by the drive mechanism configured from a motor, a gear wheel and the like not shown.

Toner supply bias voltage application unit 238 is used for applying a toner supply bias voltage to the magnetic roller 232. By supplying the toner supply bias voltage, the toner of the two-component developer that was conveyed close to the development roller 231 by the magnetic roller 232 is caused to jump to the development roller 231.

Moreover, the development bias voltage application unit 239 is used for applying a development bias voltage to the development roller 231. By applying the development bias voltage, the toner that was carried close to the photoreceptor drum 135 by the development roller 231 is caused to jump to the photoreceptor drum 135.

Specifically, the development process is performed as follows (refer to FIG. 3).

The two-component developer 303 containing the toner 301 charged by the paddle mixer 233 and the agitation mixer 234, and the carrier 302 is supplied to the magnetic roller 232. The two-component developer 303 that was supplied to the magnetic roller 232 is carried toward the development roller 231 by the magnetic roller 232. The two-component developer 303 that is being carried by the magnetic roller 232 passes between the regulation blade 235 and the magnetic roller 232 before it is carried close to the development roller 231, and the thickness of the developer layer is thereby restricted. A potential difference is generated between the development roller 231 and the magnetic roller 232 by the toner supply bias voltage that was applied by the toner supply bias voltage application unit 238. Thus, when the two-component developer 303 whose thickness was restricted moves close to the development roller 231, only the charged toner 301 is transferred to the development roller 231 from the two-component developer 303 whose thickness was restricted by the foregoing potential difference. The toner 301 that was transferred to the development roller 231 becomes a uniform toner layer.

Note that, as the two-component developer 303, for example, a type containing the toner 301 and the carrier 302 is used. As the toner 301, used may be, for example, a type that is configured by containing toner particles which contain binder resin, colorant, release agent and the like, and an external additive to be externally added to the toner particles. As the toner 301, so-called nonmagnetic toner can be preferably used. The carrier 302 is made from magnetic particles made of ferrite or the like, and is used for charging the toner 301.

Moreover, the developer supply container 240 is a supply unit for supplying the supply developer containing the toner 301 and the carrier 302 in the developer container 236 via the developer supply port 236*g* described later.

Moreover, a prescribed amount of the toner 301 and the carrier 302 is filled in advance in the developer container 236 of the developing device 23. The toner 301 is supplied as needed from the developer supply container (supply unit) 240 into the developer container 236. In addition, in the case of the image forming apparatus according to the present embodiment, the carrier 302 is supplied to the developer container 236 together with the toner 301 from the supply unit 240, rather than just the toner 301 from the supply unit 240. In other words, the supply developer containing the toner 301 and the carrier 302 is supplied as needed.

A potential difference is also generated between the photoreceptor drum 135 and the development roller 231 by the development bias voltage application unit 239. Thus, when the toner on the development roller 231 moves close to the photoreceptor drum 135, the toner 301 is caused to jump due to the foregoing potential difference and becomes attached to the image portion of the electrostatic latent image formed on the peripheral surface of the photoreceptor drum 135; in other words, so-called nonmagnetic, noncontact development is performed. The developing device 23 is thereby able to perform development process based on the electrostatic latent image.

Moreover, the development bias voltage application unit 239 includes an AC power source for applying an AC voltage. In other words, the development bias voltage that is applied by the development bias voltage application unit 239 contains an AC component. Moreover, the development bias voltage application unit 239 may additionally include a DC power source for applying a DC voltage. In other words, the development bias voltage that is applied by the development bias voltage application unit 239 may be a superimposed voltage in which the AC component is superimposed on the DC component.

Moreover, the toner supply bias voltage application unit 238 includes an AC power source for applying AC voltage and a DC power source for applying DC voltage. In other words, the development bias voltage that is applied by the toner supply bias voltage application unit 238 is superimposed voltage in which the AC component is superimposed on the DC component.

Figure 4:
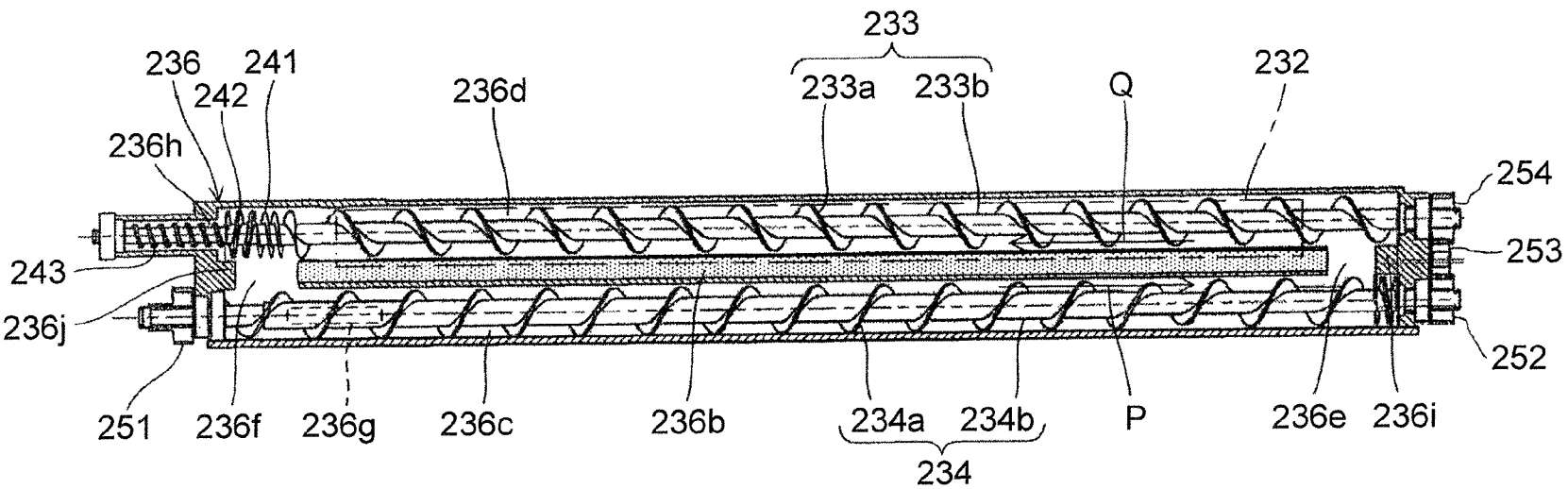
FIG. 4 is a schematic cross section showing agitation/conveying members viewed from the cross section line IV-IV in the developing device shown in FIG. 2 and the periphery thereof.

The agitation/conveying member 237 is now explained with reference to FIG. 4. Note that FIG. 4 is a schematic cross section showing the agitation/conveying member 237 and the periphery thereof viewed from the cross section line IV-IV in the developing device 23 shown in FIG. 2.

The developer container 236 is formed, as described above, with a first conveying path 236*c*, a second conveying path 236*d*, and a partitioning part 236*b*. The developer container 236 is additionally formed with an upstream side communicating part 236*e*, a downstream side communicating part 236*f*, a developer supply port 236*g*, a developer outlet 236*h*, an upstream side wall part 236*i*, and a downstream side wall part 236*j*. Note that, in the first conveying path 236*c*, the left side of FIG. 4 is the upstream side and the right side of FIG. 4 is the downstream side, and, in the second conveying path 236*d*, the right side of FIG. 4 is the upstream side and the left side of FIG. 4 is the downstream side. Moreover, the communicating part and the side wall part are referred to as upstream and downstream with the second conveying path 236*d* as the reference.

The partitioning part 236*b* partitions the first conveying path 236*c* and the second conveying path 236*d* in a parallel manner by extending in the longitudinal direction of the developer container 236. The right side end of the partitioning part 236*b* in the longitudinal direction forms the upstream side communicating part 236*e* together with the inner wall part of the upstream side wall part 236*i*. Meanwhile, the left side end of the partitioning part 236*b* in the longitudinal direction forms the downstream side communicating part 236*f* together with the inner wall part of the downstream side wall part 236*j*. The developer is thereby able to circulate in the first conveying path 236*c*, the upstream side communicating part 236*e*, the second conveying path 236*d*, and the downstream side communicating part 236*f*.

The developer supply port 236*g* is an opening provided at the upper part of the developer container 236 for supplying the new toner and carrier; that is, the supply developer from the developer supply container (supply unit) 240 into the developer container 236. The developer supply port 236*g* is disposed on the upstream side (left side in FIG. 4) of the first conveying path 236*c*.

The developer outlet 236*h* is an opening for discharging the excess developer in the first and second conveying paths 236*c*, 236*d* due to the supply of the developer. The developer outlet 236*h* is provided continuously in the longitudinal direction of the second conveying path 236*d* on the downstream side of the second conveying path 236*d*.

A first agitation/conveying member 234 is disposed in the first conveying path 236*c*. Moreover, a second agitation/conveying member 233 is disposed in the second conveying path 236*d*.

The first agitation/conveying member 234 includes a rotation axis 234*b*, and a first spiral blade 234*a*. The first spiral blade 234*a* is provided integrally with the rotation axis 234*b*, and is formed in a spiral at a given pitch in the axial direction of the rotation axis 234*b*. Moreover, the first spiral blade 234*a* extends to both end sides of the first conveying path 236*c* in the longitudinal direction, and is provided to face the upstream side and downstream side communicating parts 236*e*, 236*f*. The rotation axis 234*b* is axially supported rotatably by the upstream side wall part 236*i* and the downstream side wall part 236*j* of the developer container 236.

The second agitation/conveying member 233 includes a rotation axis 233*b* and a second spiral blade 233*a*. The second spiral blade 233*a* is provided integrally with the rotation axis 233*b*, and is formed in spiral with a blade (anti-phase blade) facing a direction that is opposite to the first spiral blade 234*a* at the same given pitch as the first spiral blade 234*a* in the axial direction of the rotation axis 233*b*. Moreover, the second spiral blade 233*a* has a length that is longer than the axial direction length of the magnetic roller 232. In addition, the second spiral blade 233*a* is provided to extend to a position where it will face the upstream side communicating part 236*e*. The rotation axis 233*b* is disposed parallel to the rotation axis 234*b*. Moreover, the rotation axis 233*b* is axially supported rotatably by the upstream side wall part 236*i* and the downstream side wall part 236*j* of the developer container 236.

Moreover, in addition to the second spiral blade 233*a*, a decelerated conveying part 241, a restricting part 242 and a discharge blade 243 are integrally formed with the rotation axis 233*b*.

The decelerated conveying part 241 is disposed to be adjacent to the left side of the second spiral blade 233*a* and face the downstream side communicating part 236*f*. Moreover, the decelerated conveying part 241 is formed in a spiral with a plurality of blades facing the same direction as the second spiral blade 233*a*, and at a size that is the same as or smaller than the outer diameter of the second spiral blade 233*a* and its arrangement pitch is set to be smaller than the pitch of the second spiral blades 233*a*. The blade pitch of the decelerated conveying part 241 is ⅙ to ⅓ of the pitch of the second spiral blades 233*a*, and these blades face the opening width in the longitudinal direction of the downstream side communicating part 236*f*. Note that the blades of the decelerated conveying part 241 do not need to face the entire width of the opening of the downstream side communicating part 236*f*, but in the foregoing case, the blade on the restricting part 242 side preferably faces the opening of the downstream side communicating part 236*f*.

According to this configuration, when the rotation axis 233*b* is rotated, the developer is conveyed relatively quickly in the second conveying path 236*d* by the second spiral blade 233*a*. Meanwhile, in the decelerated conveying part 241, since the blade pitch is smaller than the pitch of the second spiral blades 233*a*, the conveying speed of the developer in the second conveying path 236*d* provided with the decelerated conveying part 241 will be slower than that by the second spiral blade 233*a*. Accordingly, the developer that is carried moves in the conveying path in an undulating matter in accordance with the outer periphery of the blade of the second spiral blade 233*a*. Here, if the pitch of the spiral blades is relatively large as with the second spiral blade 233*a*, the developer is moved quickly while the bulk of the developer is changed considerably. Meanwhile, if the pitch of the spiral blades is relatively small as with the decelerated conveying part 241, the bulk of the developer will not change much and the developer will move slowly.

The restricting part 242 is used for blocking the developer that was conveyed to the downstream side in the second conveying path 236*d*, and enabling the developer which became a prescribed amount or more in the decelerated conveying part 241 to be conveyed to the developer outlet 236*h*. The restricting part 242 is configured from the spiral blades provided to the rotation axis 233*b*. The restricting part 242 is formed in a spiral with a blade (anti-phase blade) facing a direction that is opposite to the second spiral blade 233*a*. In addition, the restricting part 242 is set to be approximately the same as the outer diameter of the second spiral blade 233*a* and in a pitch that is smaller than the second spiral blades 233*a*. Moreover, the restricting part 242 forms a gap of a prescribed amount between the inner wall part of the developer container 236 such as the downstream side wall part 236*j* and the outer peripheral part of the restricting part 242. The excess developer is discharged from this gap.

The rotation axis 233*b* extends to the inside of the developer outlet 236*h*. A discharge blade 243 is provided to the rotation axis 233*b* inside the developer outlet 236*h*. The discharge blade 243 is configured from a spiral blade facing the same direction as the second spiral blade 233*a*. The discharge blades 243 have a pitch that is smaller than that of the second spiral blades 233*a* and the outer periphery of the blades is smaller than that of the second spiral blades 233*a*. Accordingly, when the rotation axis 233*b* rotates, the discharge blade 243 also rotates. As a result of the discharge blade 243 rotating, the excess developer that flowed over the restricting part 242 and was conveyed into the developer outlet 236*h* is delivered to the left side of FIG. 4 and discharged outside the developer container 236. Note that the discharge blade 243, the restricting part 242, the decelerated conveying part 241, and the second, spiral blade 233*a* are integrally resin-molded with the rotation axis 233*b* using synthetic resin.

Gear wheels 251 to 254 are disposed on the outer wall of the developer container 236. The gear wheels 251, 252 are fixed to the rotation axis 234*a*. The gear wheel 254 is fixed to the rotation axis 233*b*. The gear wheel 253 is supported rotatably by the developer container 236 and engages with the gear wheels 252, 254.

Accordingly, during the development where new developer is not supplied to the developer container 236, when the gear wheel 251 is rotated by a drive source such as a motor, the first spiral blade 234*a* rotates together with the rotation axis 234*b*. By the rotation of the first spiral blade 234*a*, the developer in the first conveying path 236*c* is conveyed in the arrow P direction. Subsequently, the conveyed developer passes through the upstream side communicating part 236*e* and is conveyed into the second conveying path 236*d*. In addition, the second spiral blade 233*a* which operates simultaneously with the rotation axis 233*b* rotates together with the rotation axis 233*b*, and the developer that was conveyed into the second conveying path 236*d* is conveyed by the second spiral blade 233*a* in the arrow Q direction, and conveyed to the decelerated conveying part 241. Here, By the rotation of the first spiral blade 234*a* and the second spiral blade 233*a*, the developer is conveyed relatively quickly while considerably changing its bulk. Meanwhile, in the vicinity of the decelerated conveying part 241, by the rotation of the decelerated conveying part 241, the change in the bulk of the developer is small, and the developer is carried relatively slowly. As a result of being carried relatively slowly as described above, the developer will not flow over the restricting part 242, and it will pass through the downstream side communicating part 236*f* and be conveyed to the first conveying path 236*c*.

As described above, the developer is agitated while circulating from the first conveying path 236*c* to the upstream side communicating part 236*e*, the second conveying path 236*d*, and the downstream side communicating part 236*f*, and the agitated developer is supplied to the magnetic roller 232.

The case where the developer is supplied from the developer supply port 236*g* is now explained. When the toner is consumed due to development, the supply developer containing the toner and the carrier is supplied from the developer supply port 236*g* into the first conveying path 236*c*.

The supplied developer is conveyed through the first conveying path 236*c* in the arrow P direction by the first spiral blade 234*a* as during the development. Subsequently, the conveyed developer passes through the upstream side communicating part 236*e* and is conveyed into the second conveying path 236*d*. In addition, the developer is conveyed through the second conveying path 236*d* in the arrow Q direction by the second spiral blade 233*a*, and conveyed into the decelerated conveying part 241. When the restricting part 242 rotates pursuant to the rotation of the rotation axis 233*b*, conveying force in an opposite direction of the developer conveying direction by the second spiral blade 233*a* is applied to the developer by the restricting part 242. By this restricting part 242, the developer is blocked in the vicinity of the decelerated conveying part 241 and becomes a bulk, and the excess developer flows over the restricting part 242 and is discharged outside the developer container 236 via the developer outlet 236*h*.

The image forming apparatus according to an embodiment of the present disclosure is an image forming apparatus that does not only supply the toner, but supplies the supply developer containing the toner and the carrier; that is, it is an image forming apparatus of a so-called trickle developing system, wherein, when the ratio of mass of inorganic fine particles attached to the carrier contained in the two-component developer housed in the developer container (developer tank) to mass of the carrier is A, and when the ratio of mass of inorganic fine particles attached to the carrier contained in the supply developer in which may be supplied to the developer container from the developer supply container (supply unit) through the developer supply port to mass of the carrier contained in the supply developer is B, the following Formula (1) is satisfied. Note that the present disclosure is not limited to the image forming apparatus of the foregoing configuration so as long as it is an image forming apparatus that does not only supply the toner, but supplies the supply developer containing the toner and the carrier; that is, it is an image forming apparatus of a so-called trickle developing system. In other words, the image forming apparatus of the present disclosure will suffice so as long as it is an image forming apparatus comprising a developer tank which houses two-component developer containing toner and carrier, and a supply unit which supplies the developer tank with supply developer containing toner and carrier, wherein, when the ratio of mass of inorganic fine particles attached to the carrier contained in the two-component developer to mass of the carrier contained in the two-component developer is A, and when the ratio of mass of inorganic fine particles attached to the carrier contained in the supply developer to mass of the carrier contained in the supply developer is B, the following Formula (1) is satisfied:

$$0.7<B/A<0.96 \quad (1).$$

With this image forming apparatus, even when image formation is performed over a long period of time, charged amount of the toner will not deteriorate easily, thereby, it is possible to form high quality images in which the generation of fogging and the like can be inhibited.

The reasons for this are speculated to be as follows.

Foremost, as a result of preliminarily attaching the inorganic fine particles to the carrier of the supply developer to be supplied to the developer tank, it is considered that it is possible to inhibit the inorganic fine particles as the external additive of the toner from being preferentially transferred to the carrier of the supply developer immediately after supplying the supply developer into the developer tank.

In addition, if the ratio A of the inorganic fine particles attached to the carrier of the two-component developer housed in the developer tank is too high, or the ratio B of the inorganic fine particles attached to the carrier of the supply developer to be supplied to the developer tank is too low and B/A becomes 0.7 or less, it is considered that the effect of preliminarily attaching the inorganic fine particles to the carrier of the supply developer will diminish. Thus, it is considered that the charge application performance of the carrier of the two-component developer becomes too low, or the charge application performance of the carrier of the supply developer becomes too high. Consequently, the charging of the toner in the developer tank becomes insufficient, thereby causing fogging and the like due to a charging failure of the toner, and whereby favorable images cannot be formed.

Moreover, if the ratio A of the inorganic fine particles attached to the carrier of the two-component developer housed in the developer tank is too low, or the ratio B of the inorganic fine particles attached to the carrier of the supply developer to be supplied to the developer tank is too high and B/A becomes 0.96 or more, although the difference between the charge application performance of the carrier of the two-component developer housed in the developer tank and the charge application performance of the carrier of the supply developer to be supplied to the developer tank can be reduced, it is considered that the charge application performance of the carrier of the two-component developer becomes too high or the charge application performance of the carrier of the supply developer becomes too low. Consequently, the charging of the toner in the developer tank becomes insufficient, thereby causing fogging and the like due to a charging failure of the toner, and whereby favorable images cannot be formed.

Meanwhile, by increasing the ratio of the inorganic fine particles attached to the carrier of the two-component developer housed in the developer tank to be higher than the ratio of the inorganic fine particles attached to the carrier of the supply developer to be supplied to the developer tank so as to satisfy the foregoing Formula (1), it is considered that the difference in the charge application performance of the carrier of the two-component developer housed in the developer tank and the charge application performance of the carrier of the supply developer to be supplied to the developer tank can be reduced.

Accordingly, since it is possible to inhibit the inorganic fine particles as the external additive of the toner from becoming preferentially transferred to the carrier of the supply developer immediately after supplying the supply developer to the developer tank and reduce the difference in the charge application performance of the carrier of the two-component developer and the carrier of the supply developer, it is considered that the toner is sufficiently charged and the charged state also becomes uniform. Thus, it is considered that the charged amount of the toner will not deteriorate easily and thereby it is possible to form high quality images capable of inhibiting the generation of fogging and the like.

Moreover, although it will suffice for the ratio A of the inorganic fine particles attached to the carrier of the two-component developer housed in the developer tank and the ratio B of the inorganic fine particles attached to the carrier of the supply developer to be supplied to the developer tank to satisfy the foregoing Formula (1), preferably the following Formula (2) is satisfied:

$$0.8 \leq B/A \leq 0.9 \quad (2).$$

It is thereby possible to form even higher quality images. This is considered to a result of being able to suitably reduce the difference in the charge application performance of the carrier of the two-component developer housed in the developer tank and the charge application performance of the carrier of the supply developer to be supplied to the developer tank.

Note that the proportion of the ratio B of the inorganic fine particles attached to the carrier of the supply developer to be supplied to the developer tank to the ratio A of the inorganic fine particles attached to the carrier of the two-component developer housed in the developer tank; that is, B/A can be obtained, for example, as follows.

Foremost, the toner is separated from the two-component developer. The carrier that was obtained as a result of separating the toner is measured with an X-ray fluorescence spectrometer to measure the concentration of the contained elements. Consequently, the elements contained only in the inorganic fine particles; that is, if silica particles are used as the inorganic fine particles in this case, the concentration of silicon is measured. Subsequently, the concentration of elements contained only in the inorganic fine particles which are contained in the carrier obtained by separating the toner from the supply developer is measured. B/A can thereby be obtained by dividing the concentration of the elements contained only in the inorganic fine particles which are contained in the carrier obtained by separating the toner from the supply developer by the concentration of elements contained only in the inorganic fine particles which are contained in the carrier obtained by separating the toner from the two-component developer. Note that, although there is no particular limitation in the X-ray fluorescence spectrometer, for example, RIX2100 manufactured by Rigaku Corporation can be used.

Moreover, the relationship of the ratio B of the inorganic fine particles attached to the carrier of the supply developer to be supplied to the developer tank to the ratio A of the inorganic fine particles attached to the carrier of the two-component developer housed in the developer tank will suffice so as long as the inorganic fine particles are respectively attached to the carrier of the two-component developer and the carrier of the supply developer so as to satisfy the foregoing Formula (1), and there is no particular limitation in the method thereof. For example, the agitation speed of the developer can be adjusted to satisfy the foregoing Formula (1), or the composition of the respective developers; namely, the two-component developer and the supply developer can be adjusted to satisfy the foregoing Formula (1). More specifically, the surface condition of the carrier contained in the respective developers; namely, the two-component developer and the supply developer can be changed or the mixing ratio of the carrier and the toner can be changed so that the amount of inorganic fine particles attached to the surface thereof satisfies the foregoing Formula (1).

Moreover, there is no particular limitation in the inorganic fine particles that are respectively attached to the carrier of the two-component developer and the carrier of the supply developer. For example, considered may be those in which the inorganic fine particles contained as an external additive in the toner are transferred and attached to the carrier. In other words, the toner contained in the two-component developer contains toner mother particles, and inorganic fine particles that are externally added to the toner mother particles, and the inorganic fine particles attached to the carrier contained in the two-component developer are the inorganic fine particles contained in the toner in the two-component developer transferring to the carrier. Moreover, the toner contained in the supply developer contains toner mother particles, and inorganic fine particles that are externally added to the toner mother particles, and the inorganic fine particles attached to the carrier contained in the supply developer are the inorganic fine particles contained in the toner in the developer transferring to the carrier. In other words, the toner contained in the two-component developer and the supply developer contains toner mother particles, and inorganic fine particles that are externally added to the toner mother particles, respectively, and the inorganic fine particles attached to the carrier contained in the two-component developer and the supply developer are the inorganic fine particles contained in the toner to the carrier, respectively. Preferably, the amount of inorganic fine particles that are transferred from the toner satisfies the foregoing Formula (1). It is thereby possible to form high quality images over a long period of time. This is considered to be a result of being able to suitably adjust both the amount of inorganic fine particles that are transferred from the toner and which are attached to the carrier contained in the two-component developer and the amount of inorganic fine particles that are transferred from the toner and which are attached to the carrier contained in the supply developer.

There is no particular limitation in the two-component developer and the supply developer that are used herein so as long as they can satisfy the foregoing Formula (1). Specifically, for example, the following may be used.

[Two-Component Developer]

The two-component developer contains toner and carrier. As its toner, there are types that contain toner mother particles containing binder resin and colorant or the like, and inorganic fine particles that are externally added to the toner mother particles.

<Toner Mother Particles>

Moreover, there is no particular limitation in the toner mother particles so as long as they are of a mode that can be used as toner mother particles. Moreover, the particle diameter thereof is specifically, for example, preferably 4.5 to 9 μm based on a mean volume particle diameter.

(Binder Resin)

There is no particular limitation in the binder resin so as long as it has been used as the binder resin of the toner mother particles from the past. Specifically, for example, polystyrene-based resin such as styrene-acrylic resin and styrene-butadiene resin; olefinic resin such as acrylic resin; polyethylene-based resin, and polypropylene-based resin; vinyl chloride-based resin; polyester-based resin; polyamide-based resin; polyurethane-based resin; polyvinyl alcohol-based resin; vinyl ether-based resin; and N-vinyl-based resin can be used. Among the above, polyester-based resin is preferably used since they have a relatively low softening point, superior low temperature fixing performance, and broad non-offset temperature range. Moreover, as the binder resin, each of the foregoing binder resin can be used independently or in a combination of two or more types.

As the polyester-based resin, for example, those obtained by the condensation polymerization or co-condensation polymerization of the alcohol component and carboxylic acid component can be used. Moreover, as the components to be used in the synthesis of the polyester-based resin, there are the following.

There is no particular limitation in the alcohol component so as long as it is alcohol that can be used for synthesizing the polyester-based resin. Moreover, as the alcohol component, alcohol (dihydric or higher polyhydric alcohol) with two or more hydroxyl groups in the molecules needs to be contained. Among those which can be used as the alcohol component, as the dihydric alcohol; specifically, for example, used may be diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogen-added bisphenol A, polyoxyethylenated bisphenol A, and polyoxypropylenated bisphenol A. Moreover, among those which can be used as the alcohol component, as trihydric alcohol or greater; specifically, for example, used may be sorbitol, 1,2,3,6-hexantetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene. Moreover, as the alcohol component, each of the foregoing components can be used independently or in a combination of two or more types.

Moreover, there is no particular limitation in the carboxylic acid component so as long as it can be uses as carboxylic acid for synthesizing the polyester-based resin. Moreover, as the carboxylic acid component, acid anhydride and lower alkyl ester of the carboxylic acid are also included in addition to the carboxylic acid. As the carboxylic acid component, carboxylic acid (dicarboxylic or higher polycarboxylic acid) with two or more hydroxyl groups in the molecules needs to be contained. Among those which can be used as the carboxylic acid, as the dicarboxylic acid; specifically, for example, used may be maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkyl succinic acid, and alkenyl succinic acid. As the alkyl succinic acid, for example, used may be n-butyl succinic acid, n-octyl succinic acid, n-dodecyl succinic acid, and isododecyl succinic acid. As the alkenyl succinic acid, for example, used may be n-butenyl succinic acid, isobutyl succinic acid, isobutenyl succinic acid, n-octenyl succinic acid, n-dodecenyl succinic acid, and isododecenyl succinic acid. Moreover, among those which can be used as the carboxylic acid, as the tricarboxylic acid or greater; specifically, for example, used may be 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxylic-2-methyl-2-methylene carboxy propane, 1,2,4-cyclohexane tricarboxylic acid, tetra(methylene carboxyl) methane, 1,2,7,8-octane tetracarboxylic acid, pyromellitic acid, and EnPol trimer acid. Moreover, as the carboxylic acid component, each of the foregoing components can be used independently or in a combination of two or more types.

As the polystyrene-based resin, it may be a styrene homopolymer or a copolymer with other copolymerized monomers that can be copolymerized with styrene. As the copolymerized monomer, used may be olefin-based hydrocarbons (alkene) such as p-choloro styrene; vinyl naphthalene; ethylene, propylene, butylene, and isobutylene; vinyl halides such as vinyl chloride, vinyl bromide, and vinyl fluoride; vinyl esters such as vinyl acetate, vinyl propionate, vinyl benzoate, and vinyl butyrate; ester acrylates such as methyl acrylate, ethyl acrylate, n-butyl acrylate, isobutyl acrylate, dodecyl acrylate, n-octyl acrylate, 2-choloroethyl acrylate, phenyl acrylate, and α-choloro methyl acrylate; methacrylate esters such as methyl methacrylate, ethyl methacrylate, and butyl methacrylate; acrylic acid derivatives such as acrylonitrile, methacrylonitrile, and acrylamide; vinyl ethers such as vinyl methyl ether, and vinyl isobutyl ether; vinyl ketones such as methyl vinyl ketone, ethyl vinyl ketone, and methyl isopropenyl ketone; and N-vinyl compounds such as N-vinylpyrrole, N-vinylcarbazole, N-vinylindole, and N-vinylpyrrolidone. Moreover, as the copolymerized monomer, each of the foregoing monomers can be used independently or in a combination of two or more types.

As the binder resin, from the perspective of fixing performance, it is preferable to use the foregoing thermoplastic resin, but the thermoplastic resin does not need to be used alone, and a cross-linking agent or thermosetting resin may be combined with the thermoplastic resin. As a result of introducing a partial bridged structure in the binder resin, it is possible to improve the anti-offset properties while inhibiting the deterioration in the fixing performance during the fixation of the toner to the sheet.

As the thermosetting resin; specifically, for example, epoxy-based resin such as bisphenol A-type epoxy resin, hydrogenated bisphenol A-type epoxy resin, novolac-type epoxy resin, polyalkylene ether-type epoxy resin, and cyclic aliphatic system epoxy resin, and cyanate-based resin such as cyanate resin can be used. These may be used independently or in a combination of two or more types.

(Colorant)

As the colorant, known pigments and dyes to achieve the intended color of the toner can be used. Specifically, for example, the following colorants can be used according to the color.

As the black pigment, for example, carbon black such as acetylene black, lamp black, and aniline black can be used. As the yellow pigment, for example, chrome yellow, zinc chrome, cadmium yellow, yellow iron oxide, mineral fast yellow, nickel titanium yellow, Naples yellow, naphthol yellow S, Hansa yellow G, Hansa yellow 10G, benzidine yellow G, benzidine yellow GR, quinoline yellow lake, permanent yellow NCG, Tartrazine lake, and C.I. pigment yellow 180 can be used. As the orange pigment, for example, mineral red chrome yellow, molybdenum orange, permanent orange GTR, pyrazolone orange, Vulcan orange, Indanthrene brilliant orange RK, benzidine orange G, and Indanthrene brilliant orange GK can be used. As the red pigment, colcothar, cadmium red, red lead, mercuric sulfide cadmium, permanent red 4R, lithol red, pyrazolone red, watching red calcium salt, lake red D, brilliant carmine 6B, eosin lake, rhodamine lake B, alizarin lake, brilliant carmine 3B, and C.I. pigment red 238 can be used. As the violet pigment, for example, manganese violet, fast violet B, and methyl violet lake can be used. As the blue pigment, for example, iron blue, cobalt blue, alkali blue lake, Victoria blue lake, phthalocyanine blue, nonmetal phthalocyanine blue, phthalocyanine blue partial chlorination product, fast skyblue, Indanthrene blue BC, and C.I. pigment blue 15:3 (copper phthalocyanine blue pigment) can be used. As the green pigment, for example, chromium green, chromium oxide, pigment green B, malachite green lake, and fanal yellow green G can be used. As the white pigment, for example, zinc oxide, titanium oxide, antimony white, zinc sulfide, barite powder, barium carbonate, clay, silica, white carbon, talc, and alumina white can be used. For example, as the colorant of cyan toner, C.I. pigment blue 15:3 (copper phthalocyanine blue pigment) is preferably. Moreover, as the dye, for example, acid violet and the like can be used.

Although there is no particular limitation in the content of the colorant, in order to achieve an appropriate image density, it is preferably 1 to 10 parts by mass relative to the 100 parts by mass of the binder resin.

(Wax)

It is standard for the toner mother particles to contain wax in order to improve the fixing performance and offset properties.

As the wax, there is no particular limitation so as long as it has been used as wax of the toner mother particles from the past. Preferably, for example, olefin-based wax such as polyethylene wax and polypropylene wax, fluororesin-based wax such as polytetrafluoroethylene-based wax, Fischer-Tropsch wax, paraffin wax, ester wax, montan wax, rice wax and the like can be used. The foregoing wax can be used independently or in a combination of two or more types. By adding the foregoing wax, the fixation offset and image smearing can be efficiently prevented.

Although there is no particular limitation in the wax content, the content is preferably 1 to 5 parts by mass relative to the 100 parts by mass of the binder resin. If the wax content is too small, there is a possibility that the fixation offset and image smearing cannot be efficiently prevented. Meanwhile, if the blending quantity of wax is too great, the toners themselves will become fused, and there is a possibility that the preservation stability will deteriorate.

(Charge-Controlling Agent)

The toner mother particles generally contain a charge-controlling agent for controlling the charging characteristics such as the frictional charging characteristics of the toner. The charge-controlling agent is blended to considerably improve the charging level and charge rise characteristics (index of charging to a constant electric charge level in a short period of time), and obtain superior characteristics in terms of durability and stability. In other words, a charge-controlling agent with positive charging characteristics (positive charging characteristic charge-controlling agent) can be added when performing the development by positively charging the toner, and a charge-controlling agent with negative charging characteristics (negative charging characteristic charge-controlling agent) can be added when performing the development by negatively charging the toner.

There is no particular limitation in the charge-controlling agent so as long as it is a charge-controlling agent of the toner mother particles which have been used from the past.

As specific examples of the charge-controlling agent with positive charging characteristics, there are, for example, azine compounds such as pyridazine, pyrimidine, pyrazine, orthooxazine, metaoxazine, paraoxazine, orthothiazine, metathiazine, parathiazine, 1,2,3-triazine, 2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made from azine compounds such as azine fast red FC, azine fast red 12BK, azine violet BO, azine brown 3G, azine light brown GR, azine dark green BH/C, azine deep black EW and azine deep black 3RL; nigrosine compounds such as nigrosine, nigrosine salt, and nigrosine derivative; acid dyes made from nigrosine compounds such as nigrosine BK, nigrosine NB, and nigrosine Z; metal salts of naphthenic acid or higher fatty acid; alkoxylated amine; alkyl amide; and quaternary ammonium salts such as benzyl methyl hexyldecyl ammonium, and decyltrimethyl ammonium chloride. These may be used independently or in a combination of two or more types. In particular, a nigrosine compound is optimal for use as the positive charging characteristics toner from the perspective of obtaining the charge rise properties more quickly.

Moreover, as the positive charging characteristic charge-controlling agent, also used may be resin or oligomer that includes quaternary ammonium salt, carboxylic acid salt or carboxyl group as its functional group. More specifically, used may be styrene-based resin containing quaternary ammonium salt, acrylic resin containing quaternary ammonium salt, styrene-acrylic resin containing quaternary ammonium salt, polyester-based resin containing quaternary ammonium salt, styrene-based resin containing carboxylic acid salt, acrylic resin containing carboxylic acid salt, styrene-acrylic resin containing carboxylic acid salt, polyester-based resin containing carboxylic acid salt, polystyrene-based resin containing a carboxyl group, acrylic resin containing a carboxyl group, styrene-acrylic resin containing a carboxyl group, and polyester-based resin containing a carboxyl group. These may be used independently or in a combination of two or more types.

In particular, the styrene-acrylic copolymer resin containing quaternary ammonium salt as its functional group is optimal from the perspective that the charged amount can be adjusted easily to a value within an intended range. In the foregoing case, as the preferable acrylic comonomer to be copolymerized with the foregoing styrene unit, (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate can be used. Moreover, as the quaternary ammonium salt, a unit that is derived from dialkyl amino alkyl (meth) acrylate via the quaternation process is used. As the dialkyl amino alkyl (meth)acrylate to be derived, for example, di(lower alkyl)amino ethyl (meth)acrylates such as dimethyl amino ethyl (meth)acrylate, diethyl amino ethyl (meth)acrylate, dipropyl amino ethyl (meth)acrylate, and dibutyl amino ethyl (meth)acrylate; dimethyl methacryl amide, and dimethyl amino propyl methacryl amide are preferably used. Moreover, it is also possible to concurrently use hydroxy group-containing polymerizable monomers such as hydroxy ethyl (meth)acrylate, hydroxy propyl (meth)acrylate, 2-hydroxy butyl (meth)acrylate, and N-methylol (meth)acrylamide during the polymerization.

As the charge-controlling agent which shows negative charging characteristics, for example, an organic metal complex or a chelate compound is effective. As examples of the chelate compound, there is aluminum acetylacetonate, iron (II) acetylacetonate, and chromium 3,5-di-tert-butylsalicylate. As the organic metal complex, an acetylacetone metal complex or salicylic acid series metal complex or salt is preferable, and a salicylic acid series metal complex or a salicylic acid series metal salt is more preferable.

The content of the charge-controlling agent is preferably 0.5 to 15 parts by mass, more preferably 0.5 to 8 parts by mass, and even more preferably 0.5 to 7 parts by mass relative to the 100 parts by mass of the binder resin. If the content of the charge-controlling agent is too small, there is a possibility that it will be difficult to stably charge the toner to a prescribed polarity. Thus, when performing image formation by developing an electrostatic latent image using toner in which it is difficult to stably charge the toner to a prescribed polarity, there is a possibility that the image density will decrease or it will be difficult to maintain the image density at a constant level. Moreover, the defective dispersion of the charge-controlling agent tends to occur, thereby causing so-called fogging or resulting in severe photoreceptor contamination. Meanwhile, if the additive amount of the charge-controlling agent is too great, this causes deterioration in the environment resistance, in particular charging failure and defective images under a high temperature, high humidity environment, and tends to cause defects such as photoreceptor contamination.

(Manufacturing Method)

Moreover, there is no particular limitation in the method of manufacturing the toner mother particles. Specifically, for example, the pulverization method, polymerization method and the like may be considered. As the method of manufacturing the toner mother particles by the pulverization method, the following manufacturing process can be adopted.

Foremost, the respective components configuring the toner mother particles such as the binder resin and the colorant are mixed with a mixer or the like. As the mixer, a known mixer may be used, and, for example, used may be a Henschel-type mixing machine such as a Henschel mixer, a super mixer, or a mechanomill, an angmill, a hybridization system, a cosmo system and the like. Among the above, the Henschel mixer can be preferably used.

Next, the obtained mixture is melted and kneaded with a kneading machine or the like. As the kneading machine, a known kneading machine can be used. For example, used may be an extruder such as a biaxial extruder, a triple roll mill, a laboratory mill and the like. Moreover, as the melting and kneading temperature, the temperature is preferably higher than the softening point of the binder resin and less than the thermal decomposition temperature of the binder resin.

Subsequently, the obtained molten kneaded material is cooled in a chilling machine to obtain a solid material, and the solid material is pulverized with a pulverizer or the like. As the chilling machine, a known chilling machine can be used; for example, used may be a drum flaker and the like. Moreover, as the pulverizer, a known pulverizer can be used. For example, used may be a pneumatic pulverizer such as a jet pulverizer (jet mill) that performs the pulverization using a supersonic jet air stream, a mechanical pulverizer such as a turbo mill, and an impact pulverizer, and the pneumatic pulverizer is preferably used.

Finally, the obtained pulverized product is classified with a classifier or the like. As a result of this classification, it is possible to remove the excessively pulverized product and coarse powder, and obtain the intended toner mother particles. As the classifier, a known classifier can be used. For example, a wind power classifier such as a elbow jet classifier of a circular wind power classifier (rotary wind power classifier) or a centrifugal classifier can be used, and a wind power classifier is preferably used.

(External Addition)

The toner is obtained by externally adding inorganic fine particles as the external additives to the toner mother particles. In other words, the toner is obtained by performing external additive treatment to the toner mother particles with the external additives described later.

As the external additive treatment, any conventionally known external additive treatment can be used without limitation. Specifically, for example, in this treatment, external additives are added to the toner mother particles and agitated with an agitator or the like so as to affix or fix the external additives to the surface of the toner mother particles.

There is no particular limitation in the inorganic fine particles so as long as they can be used as the external additive of the toner. Specifically, for example, inorganic fine particles of titanium dioxide particles (titania particles), silicon dioxide particles (silica particles), aluminum oxide particles (alumina particles), zinc oxide particles, and magnetite particles can be used. Among the above, titanium dioxide particles, silicon dioxide particles, and aluminum oxide particles are preferable from the perspective that they are superior in fluidity, charging characteristics, and grindability. In other words, higher quality images can be formed over a long period of time by using at least one type selected from the group consisting of titanium dioxide particles, silicon dioxide particles, and aluminum oxide particles as the inorganic fine particles. This is considered to be a result of being able to increase the fluidity and grindability of the toner as well as being able to appropriately charge the toner. Moreover, as the external additive, the foregoing external additives can be used independently or in a combination of two or more types.

Moreover, the additive amount of the external additives to the toner mother particles is preferably 0.2 to 3 parts by mass relative to 100 parts by mass of the toner mother particles.

As the agitator, a conventionally known agitator can be used without limitation. Specifically, for example, general agitators such as a turbine-type agitator, a Henschel mixer, and a super mixer can be used, and a Henschel mixer is preferably used.

<Carrier>

There is no particular limitation in the carrier so as long as it can be used as carrier of the developer. Specifically, for example, ferrite carrier, or carrier containing a core material and a coating resin for coating the core material may be used.

Moreover, there is no particular limitation in the core material so as long as it has been used as carrier of electrographic developer (two-component developer) from the past. Specifically, for example, metal such as iron, nickel, and cobalt; alloy containing the foregoing metal; iron-based oxide such as ferrite and magnetite; and magnetic particles containing the magnetic materials of the foregoing mixture can be used. As the magnetic particles, for example, magnetic substance particles manufactured by sintering and atomizing the magnetic material can be used. Among the above, ferrite particles can be preferably used.

Moreover, as the particle diameter of the core material, preferably, based on the volume mean diameter, it is preferably 20 to 50 μm, and more preferably 25 to 45 μm. Note that the volume mean diameter can be measured, for example, based on measurement with an electron microscope, measurement based on the laser diffraction and scattering method, and measurement by using a standard particle size analyzer.

There is no particular limitation in the coating resin so as long as it can be used as the coating resin of the carrier. Specifically, for example, acrylic resins such as epoxy resin, silicon resin, and fluorine-containing acrylic resin; fluorine-based resin such as polytetrafluoro ethylene (PTFE), polycholoro trifluoro ethylene, polyvinylidene fluoride, tetrafluoro ethylene-perfluoro alkyl vinyl ether copolymer (PFA), tetrafluoro ethylene-hexafluoro propylene copolymer (FEP), and; polyamide resin, polyimide resin, and polyamideimide resin can be used. Among the above, the fluorine-containing acrylic resin can be preferably used. Moreover, as the coating resin, each of the foregoing coating resin can be used independently or in a combination of two or more types.

Moreover, there is no particular limitation in the coating amount of the coating resin upon relative to the core material. Specifically, for example, the coating amount is preferably 0.5 to 10 parts by mass relative to 100 parts by mass of the core material. If the coating amount of the coating resin is too small, there is a possibility that the coating resin may not be able to sufficiently increase the charge stability, durability and the like. Moreover, if the coating amount of the coating resin is too great, the magnetism of the carrier core material will be blocked by the thick coating layer, and, since it becomes difficult to magnetically support the carrier on the development roller, a phenomenon where the carrier jumps to the photoreceptor tends to occur. Thus, as a result of the coating amount of the coating resin being within the foregoing range, it is considered that it is possible to inhibit the scraping or peeling of the coating resin and additionally increase the charge stability, and it is thereby possible to form higher quality images over a long period of time.

Moreover, as the manufacturing method of the carrier, there is no particular limitation so as long as the coating resin is able to coat the core material. Specifically, for example, used may be a method of coating the core material with liquid coating resin and thereafter performing heat treatment in order to solidify the coating resin. As the coating method, for example, the fluidized bed coating method and dipping method can be used.

The toner concentration in the two-component developer is preferably 3 to 20 mass percent, and more preferably 5 to 15 mass percent. If the toner concentration is too low, the image density tends to become too light. Meanwhile, if the toner concentration is too high, toner dispersion will occur in the developing device, and there is a possibility that the inside of the device will become stained or troubles such as the toner becoming attached to an unintended location of the paper.

[Supply Developer]

The supply developer is now explained.

The supply developer contains toner and carrier. As the toner, used may be toner which contains toner mother particles containing binder resin, colorant and the like, and inorganic fine particles that are externally added to the toner mother particles.

The toner and the carrier in the supply developer can be the same type as the two-component developer.

Unlike the two-component developer, the toner content in the supply developer is greater in comparison to the carrier. In other words, the supply developer is used for supplying the toner to the developer tank, as well as supplying a small amount of carrier. Specifically, the carrier content is preferably 1 to 20 parts by mass and more preferably 1 to 10 parts by mass relative to 100 parts by mass of the toner. If the carrier content is too small, there is a possibility that preventing the deterioration in the carrier's performance by supplying the carrier upon supplying the toner over a long period of time cannot be sufficiently exhibited. In other words, there is a possibility that the effects of the trickle developing system cannot be sufficiently exhibited. Thus, there is a possibility that the longer service life of the image forming apparatus cannot be sufficiently achieved. Moreover, if the carrier content is too great, there is a possibility that the carrier will become slanted before being supplied to the developer tank; that is, inside the developer supply container. Moreover, if the agitation property in the development supply container is increased in order to prevent the foregoing slant, there is a possibility that the deterioration of the carrier will progress. Thus, as a result of the maintaining the carrier content of the supply developer within the foregoing range, higher quality images can be formed over a longer period of time. This is considered to be based on the following reasons. As a result of using this kind of supply developer, it is possible to realize an appropriate toner concentration capable of obtaining high quality images of a favorable image density, and additionally suitably adjust the amount of inorganic fine particles that will become attached to the carrier. Thus, it is considered that it is possible to sufficiently inhibit the deterioration in the carrier performance over a long period of time.

EXAMPLES

The present disclosure is now explained in further detail based on the following Examples. Note that the present disclosure is not limited by the Examples in any way.

Example 1

The manufacturing method of two-component developer used in Example 1 is foremost explained.

(Manufacture of Toner)

Foremost, 100 parts by mass of polyester resin (Tufton NE-1110 manufactured by Kao Corporation) obtained by subjecting bisphenol A and fumaric acid to polycondensation as the binder resin, 4 parts by mass of carbon black (MA-100 manufactured by Mitsubishi Chemical Corporation) as the colorant, 3 parts by mass of Fischer-Tropsch wax (FT-100 manufactured by Nippon Seiro Co., Ltd.) as the wax, and 2 parts by mass of quaternary ammonium salt compound (P-51 manufactured by Orient Chemical Industries Co., Ltd.) as the charge-controlling agent were mixed with a Henschel mixer (manufactured by Nippon Coke & Engineering Co., Ltd.) for 2 minutes. Subsequently, the obtained mixture was melted and kneaded with a biaxial extruder (PCM-30 manufactured by Ikegai Corporation). The obtained molten kneaded material was pulverized with a pneumatic pulverizer (jet mill IDS-2 manufactured by Nippon Pneumatic Mfg. Co., Ltd.), and subject to classification processing with a pneumatic classifier (TPS classifier manufactured by Hosokawa Micron Corporation). It was thereby possible to obtain toner mother particles having a mean volume particle diameter of 7 μm. Note that the mean volume particle diameter of the toner mother particles was measured using a particle size analyzer (Multisizer 3 manufactured by Beckman Coulter K.K.).

Subsequently, 2 parts by mass of silica particles (TG-820 manufactured by Cabot Corporation) were added as the external additive (inorganic fine particles) to the obtained 100 parts by mass of toner mother particles, and mixed with the foregoing Henschel mixer at 3000 rpm for 10 minutes. It was thereby possible to obtain black toner (toner mother particles to which inorganic fine particles were externally added).

(Manufacture of Carrier)

Foremost, 30 parts by mass of epoxy resin solution (Epicoat 1001T75 manufactured by Mitsubishi Chemical Corporation) and 70 parts by mass of fluorine-containing acrylic resin (FS701 manufactured by Nippon Paint Co., Ltd.) were agitated until a uniform solution was obtained. It was thereby possible to obtain a coating resin solution.

Subsequently, ferrite core carrier (EF-35B manufactured by Powdertech Co., Ltd., mean volume diameter: 35 μm; strength of mass magnetization: 68 emu/g) was used as the core material, and 5 parts by mass of the coating resin was used to coat the foregoing 100 parts by mass of the core material using a fluid coating system (MP-1 manufactured by Powerex Corporation). Obtained object was thereafter subject to heat treatment at 280° C. for one hour. The coating resin that was used to coat the core material was thereby solidified, and it was possible to obtain carrier (core material coated with coating resin).

(Manufacture of Supply Developer)

Foremost, 1 kg of the toner and 100 g of the carrier were housed in a 3-L plastic container, and the plastic container housing the toner and the carrier was shaken with a universal ball mill (UB32 manufactured by Yamato Scientific Co., Ltd.) at a shake speed of 60 rpm for 3 minutes. Supply developer was thereby obtained. Note that the carrier content in the foregoing case was 10 parts by mass relative to 100 parts by mass of the toner.

Subsequently, the toner was sucked and separated from the obtained supply developer. The concentration of elements contained in the carrier obtained as a result of separating the toner was measured using an X-ray fluorescence spectrometer (RIX2100 manufactured by Rigaku Corporation). Here, the elements contained only in the inorganic fine particles; that is, since silica particles are used as the inorganic fine particles in this case, the concentration of silicon was measured. The measured silicon concentration was 0.040 mass percent.

(Manufacture of Two-Component Developer)

Foremost, 1 kg of the carrier was housed in a 1-L plastic container, and the plastic container housing the carrier was shaken with a universal ball mill (UB32 manufactured by Yamato Scientific Co., Ltd.) at a shake speed of 120 rpm for 20 minutes. It was thereby possible to obtain carrier with a rough surface. Subsequently, 1 kg of the obtained carrier and 100 g of the toner were housed in a 3-L plastic container, and the temperature of the toner and the carrier was adjusted to 40° C. The plastic container housing the toner and the carrier was shaken with a universal ball mill (UB32 manufactured by Yamato Scientific Co., Ltd.) at a shake speed of 60 rpm for 20 minutes. Two-component developer was thereby obtained.

Subsequently, the toner was sucked and separated from the obtained two-component developer. The concentration of the elements contained in the carrier obtained as a result of separating the toner was measured using an X-ray fluorescence spectrometer (RIX2100 manufactured by Rigaku Corporation). Here, the elements contained only in the inorganic fine particles; that is, since silica particles are used as the inorganic fine particles in this case, the concentration of silicon was measured. The measured silicon concentration was 0.050 mass percent.

Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.8. Note that the type of the inorganic fine particles, the ratio A of the inorganic fine particles attached to the carrier of the two-component developer housed in the developer tank, the ratio B of the inorganic fine particles attached to the carrier of the supply developer to be supplied to the developer tank, B/A, and the carrier content (parts by mass) relative to 100 parts by mass of the toner in supply developer are summarized and shown in following Table 1.

Next, a color MFP (KM-C3232) manufactured by Kyocera Mita Corporation was remodeled having a trickle developing system in place of its two-component developing system and used as the image forming apparatus, and the two-component developer was housed in the developer tank of the remodeled image forming apparatus and the supply developer was additionally housed in the developer supply container. The image forming apparatus obtained as described above was used to perform image formation under a normal temperature, normal humidity environment at a temperature of 20 to 23° C. and a relative humidity of 50 to 65% RH, and the following evaluations were performed.

Specifically, foremost, the power of the image forming apparatus was turned ON and the image forming apparatus was stabilized. An image including 2 cm×2 cm solid images was thereafter output. Note that this image was considered the initial image (first sheet). Here, the development bias voltage was adjusted so that the image density ID of the solid image becomes roughly 1.4. Next, 3,000 sheets of an image having a coverage rate of 0.2% were printed while supplying the supply developer. Note that the same image as the initial image was output on the 3000th sheet, and this was considered the low density printed image. Thereafter, 1,000 sheets of an image having a coverage rate of 25% were printed while supplying the supply developer. Note that the same image as the initial image was output on the 1000th (4000th from the initial image) sheets, and this was considered the high density printed image.

(Image Density)

As the respective images of the initial image, the low density printed image, and the high density printed image, the 2×2 cm solid images were formed at three locations; namely, the position in the vicinity of the left end part in the direction perpendicular to the conveying direction of the sheet, the center part, and the position in the vicinity of the right end part.

The reflection density of the respective solid images of the formed images was measured with a reflection densitometer (RD-19I manufactured by Gregtag Macbeth). The average value thereof was considered the image density of the obtained images.

The result was evaluated as "O" if the lower limit of the measured image density was 1.2 or more, and evaluated as "x" if it was less than 1.2.

(Fogging)

The value obtained by subtracting the value of the image density of the base paper (that is, the white paper before image output) from the value of the image density of the portion corresponding to the white paper that was measured with the reflection densitometer in the obtained image was used as the fogging density.

The result was evaluated as "O" if the maximum value of the fogging density was 0.010 or less, and evaluated as "x" if it was more than 0.010.

(Charged Amount)

The developer immediately after printing the initial image, the low density printed image, and the high density printed image was removed, and the developer was weighed at 0.1±0.01 g. The weighed developer was sucked by the suction pal of the suction-type compact charged amount measurement device (TREK's q/m meter MODEL 210HS-3). Consequently, only the toner was sucked, and the charge amount was measured with the suction-type compact charged amount measurement device (TREK's q/m meter MODEL 210HS-3). Note that the sucked toner amount was obtained by weighing the amount of developer before and after the suction. The charged amount (μC/g) of the toner was calculated from the measured toner amount and charge amount.

(Durable Printing)

Separate from the printing of the initial image, the low density printed image, and the high density printed image, the image forming apparatus was used to print 500,000 sheets of an image having a coverage rate of 5%. Note that an image that is the same as the initial image was printed after the printing of the 500,000 sheets, and this was considered the durable printed image.

The image density and fogging density of the obtained durable printed image were measured with a method that is the same as the foregoing method. The charged amount of the toner after the durable printing was measured with a method that is the same as the foregoing method.

These results are summarized and shown in Table 2. Note that "-" in Table 2 shows that it was not evaluated. Specifically, if the evaluation of either of the initial image, the low density printed image, or the high density printed image was unfavorable, the evaluation of the durable printing will obviously be unfavorable and, therefore, that item was not evaluated.

Example 2

Upon manufacturing the two-component developer, other than changing the time of shaking the plastic container housing the carrier from 20 minutes to 30 minutes, the same method as Example 1 was used.

The silicon concentration that was measured using the obtained two-component developer was 0.057 mass percent. Moreover, the silicon concentration that was measured using the supply developer was 0.040 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.702.

Example 3

Upon manufacturing the two-component developer, other than changing the time of shaking the plastic container housing the carrier from 20 minutes to 10 minutes, the same method as Example 1 was used.

The silicon concentration that was measured using the obtained two-component developer was 0.042 mass percent. Moreover, the silicon concentration that was measured using the supply developer was 0.040 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.952.

Example 4

Other than manufacturing the two-component developer as follows, the same method as Example 1 was used.

(Manufacture of Two-Component Developer)

Foremost, 1 kg of the carrier was housed in a 1-L plastic container, and the plastic container housing the carrier was shaken with a universal ball mill (UB32 manufactured by Yamato Scientific Co., Ltd.) at a shake speed of 120 rpm for 20 minutes. It was thereby possible to obtain carrier with a rough surface. Subsequently, 1 kg of the obtained carrier, 0.5 g of silica particles (TG-820 manufactured by Cabot Corporation), and 100 g of the toner were housed in a 3-L plastic container, and the temperature of the toner, silica particles and the carrier was adjusted to 40° C. The plastic container housing the toner, the silica particles and the carrier was shaken with a universal ball mill (UB32 manufactured by Yamato Scientific Co., Ltd.) at a shake speed of 60 rpm for 20 minutes. Two-component developer was thereby obtained.

The silicon concentration that was measured using the obtained two-component developer was 0.055 mass percent. Moreover, the silicon concentration that was measured using the supply developer was 0.040 mass percent. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.727.

Example 5

Other than manufacturing the supply developer as follows, the same method as Example 1 was used.

(Manufacture of Supply Developer)

Foremost, 1 kg of the toner and 10 g of the carrier were housed in a 3-L plastic container, and the plastic container housing the toner and the carrier was shaken with a universal ball mill (UB32 manufactured by Yamato Scientific Co., Ltd.) at a shake speed of 60 rpm for 3 minutes. Supply developer was thereby obtained. Note that the carrier content in the foregoing case was 10 parts by mass relative to 100 parts by mass of the toner.

The silicon concentration that was measured using the obtained supply developer was 0.045 mass percent. Moreover, the silicon concentration that was measured using the two-component developer was 0.050 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.9.

Example 6

Other than manufacturing the supply developer as follows, the same method as Example 1 was used.

(Manufacture of Supply Developer)

Foremost, 1 kg of the toner and 200 g of the carrier were housed in a 3-L plastic container, and the plastic container housing the toner and the carrier was shaken with a universal ball mill (UB32 manufactured by Yamato Scientific Co., Ltd.) at a shake speed of 60 rpm for 3 minutes. Supply developer was thereby obtained. Note that the carrier content in the foregoing case was 20 parts by mass relative to 100 parts by mass of the toner.

The silicon concentration that was measured using the obtained supply developer was 0.038 mass percent. Moreover, the silicon concentration that was measured using the two-component developer was 0.050 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.76.

Example 7

Upon manufacturing the toner, other than externally adding 1.5 parts by mass of titania particles (JR-405 manufactured by Tayca Corporation) in substitute for externally adding 2 parts by mass of silica particles (TG-820 manufactured by Cabot Corporation) as the external additive (inorganic fine particles) relative to 100 parts by mass of toner mother particles, the same method as Example 1 was used.

The titanium concentration that was measured using the obtained two-component developer was 0.020 mass percent. Moreover, the titanium concentration that was measured using the supply developer was 0.015 mass percent. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.75.

Example 8

Upon manufacturing the toner, other than externally adding 1 part by mass of alumina particles (A33F manufactured by Nippon Light Metal Co., Ltd.) in substitute for externally adding 2 parts by mass of silica particles (TG-820 manufactured by Cabot Corporation) as the external additive (inorganic fine particles) relative to 100 parts by mass of toner mother particles, the same method as Example 1 was used.

The aluminum concentration that was measured using the obtained two-component developer was 0.035 mass percent. Moreover, the aluminum concentration that was measured using the supply developer was 0.030 mass percent. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.857.

Comparative Example 1

Other than manufacturing the two-component developer as follows, the same method as Example 1 was used.

(Manufacture Two-Component Developer)

Foremost, 1 kg of the carrier was housed in a 1-L plastic container, and the plastic container housing the carrier was shaken with a universal ball mill (UB32 manufactured by Yamato Scientific Co., Ltd.) at a shake speed of 120 rpm for 20 minutes. It was thereby possible to obtain carrier with a rough surface. Subsequently, 1 kg of the obtained carrier, 0.6 g of silica particles (TG-820 manufactured by Cabot Corporation), and 100 g of the toner were housed in a 3-L plastic container, and the temperature of the toner, the silica particles and the carrier was adjusted to 40° C. The plastic container housing the toner, the silica particles and the carrier was shaken with a universal ball mill (UB32 manufactured by Yamato Scientific Co., Ltd.) at a shake speed of 60 rpm for 20 minutes. Two-component developer was thereby obtained.

The silicon concentration that was measured using the obtained two-component developer was 0.059 mass percent. Moreover, the silicon concentration that was measured using the supply developer was 0.040 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.678.

Comparative Example 2

Upon manufacturing the two-component developer, other than changing the time of shaking the plastic container housing only the carrier from 20 minutes to 5 minutes, the same method as Example 1 was used.

The silicon concentration that was measured using the obtained two-component developer was 0.041 mass percent. Moreover, the silicon concentration that was measured using the supply developer was 0.040 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 0.976.

Comparative Example 3

Other than manufacturing the supply developer as follows, the same method as Example 1 was used.

(Manufacture of Supply Developer)

Foremost, 1 kg of the toner and 5 g of the carrier were housed in a 3-L plastic container, and the plastic container housing the toner and the carrier was shaken with a universal ball mill (UB32 manufactured by Yamato Scientific Co., Ltd.) at a shake speed of 60 rpm for 3 minutes. Supply developer was thereby obtained. Note that the carrier content in the foregoing case was 0.5 parts by mass relative to 100 parts by mass of the toner.

The silicon concentration that was measured using the obtained supply developer was 0.034 mass percent. Moreover, the silicon concentration that was measured using the two-component developer was 0.050 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.68.

Comparative Example 4

Other than manufacturing the supply developer as follows, the same method as Example 1 was used.

(Manufacture of Supply Developer)

Foremost, 1 kg of the toner and 250 g of the carrier were housed in a 3-L plastic container, and the plastic container housing the toner and the carrier was shaken with a universal ball mill (UB32 manufactured by Yamato Scientific Co., Ltd.) at a shake speed of 60 rpm for 3 minutes. Supply developer was thereby obtained. Note that the carrier content in the foregoing case was 25 parts by mass relative to 100 parts by mass of the toner.

The silicon concentration that was measured using the obtained supply developer was 0.048 mass percent. Moreover, the silicon concentration that was measured using the two-component developer was 0.050 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was 0.96.

Comparative Example 5

Upon manufacturing the two-component developer, other than housing the carrier and the toner in a 1-L plastic container and shaking the plastic container manually to mix the contents in substitute for mixing the carrier and the toner with a mixer, the same method as Example 1 was used.

The silicon concentration that was measured using the obtained two-component developer was 0.037 mass percent. Moreover, the silicon concentration that was measured using the supply developer was 0.040 mass percent, which was the same as Example 1. Accordingly, the proportion of the ratio B of the inorganic fine particles attached to the carrier of the supply developer to be supplied to the developer tank to the ratio A of the inorganic fine particles attached to the carrier of the two-component developer housed in the developer tank; that is, B/A was approximately 1.081.

TABLE 1

| | TYPE OF INORGANIC FINE PARTICLES | RATIO OF INORGANIC FINE PARTICLES ATTACHED TO CARRIER (MASS PERCENT) | | | CARRIER CONTENT RELATIVE TO 100 |
|---|---|---|---|---|---|
| | | RATIO A OF TWO-COMPONENT DEVELOPER | RATIO B OF REPLENISHMENT DEVELOPER | B/A | PARTS BY MASS OF TONER (PARTS BY MASS) |
| EXAMPLE 1 | SILICA PARTICLES | 0.050 | 0.040 | 0.800 | 10 |
| EXAMPLE 2 | SILICA PARTICLES | 0.057 | 0.040 | 0.702 | 10 |
| EXAMPLE 3 | SILICA PARTICLES | 0.042 | 0.040 | 0.952 | 10 |
| EXAMPLE 4 | SILICA PARTICLES | 0.055 | 0.040 | 0.727 | 10 |
| EXAMPLE 5 | SILICA PARTICLES | 0.050 | 0.045 | 0.900 | 1 |
| EXAMPLE 6 | SILICA PARTICLES | 0.050 | 0.038 | 0.760 | 20 |
| EXAMPLE 7 | TITANIA PARTICLES | 0.020 | 0.015 | 0.750 | 10 |
| EXAMPLE 8 | ALUMINA PARTICLES | 0.035 | 0.030 | 0.857 | 10 |
| COMPARATIVE EXAMPLE 1 | SILICA PARTICLES | 0.059 | 0.040 | 0.678 | 10 |
| COMPARATIVE EXAMPLE 2 | SILICA PARTICLES | 0.041 | 0.040 | 0.976 | 10 |
| COMPARATIVE EXAMPLE 3 | SILICA PARTICLES | 0.050 | 0.034 | 0.680 | 0.5 |
| COMPARATIVE EXAMPLE 4 | SILICA PARTICLES | 0.050 | 0.048 | 0.960 | 25 |
| COMPARATIVE EXAMPLE 5 | SILICA PARTICLES | 0.037 | 0.040 | 1.081 | 10 |

TABLE 2

| | | IMAGE DENSITY ID | | | | | | | | FOGGING DENSITY FD | | | | | | | |
|---|---|---|---|---|---|---|---|---|---|---|---|---|---|---|---|---|---|
| | | INITIAL IMAGE (1st SHEET) | | LOW DENSITY PRINTED IMAGE (3000th SHEET) | | HIGH DENSITY PRINTED IMAGE (4000th SHEET) | | DURABLE PRINTED IMAGE | | INITIAL IMAGE (1st SHEET) | | LOW DENSITY PRINTED IMAGE (3000th SHEET) | | HIGH DENSITY PRINTED IMAGE (4000th SHEET) | | DURABLE PRINTED IMAGE | |
| EXAMPLES | 1 | 1.40 | ○ | 1.25 | ○ | 1.40 | ○ | 1.50 | ○ | 0.002 | ○ | 0.003 | ○ | 0.001 | ○ | 0.003 | ○ |
| | 2 | 1.45 | ○ | 1.30 | ○ | 1.45 | ○ | 1.52 | ○ | 0.002 | ○ | 0.002 | ○ | 0.002 | ○ | 0.002 | ○ |
| | 3 | 1.45 | ○ | 1.20 | ○ | 1.35 | ○ | 1.45 | ○ | 0.001 | ○ | 0.003 | ○ | 0.001 | ○ | 0.002 | ○ |
| | 4 | 1.44 | ○ | 1.30 | ○ | 1.44 | ○ | 1.51 | ○ | 0.003 | ○ | 0.003 | ○ | 0.000 | ○ | 0.003 | ○ |
| | 5 | 1.43 | ○ | 1.28 | ○ | 1.42 | ○ | 1.52 | ○ | 0.003 | ○ | 0.002 | ○ | 0.000 | ○ | 0.003 | ○ |
| | 6 | 1.43 | ○ | 1.23 | ○ | 1.38 | ○ | 1.45 | ○ | 0.002 | ○ | 0.002 | ○ | 0.001 | ○ | 0.000 | ○ |
| | 7 | 1.46 | ○ | 1.26 | ○ | 1.41 | ○ | 1.52 | ○ | 0.003 | ○ | 0.001 | ○ | 0.002 | ○ | 0.002 | ○ |
| | 8 | 1.43 | ○ | 1.24 | ○ | 1.39 | ○ | 1.48 | ○ | 0.003 | ○ | 0.001 | ○ | 0.000 | ○ | 0.001 | ○ |
| COMPARATIVE EXAMPLES | 1 | 1.40 | ○ | 1.35 | ○ | 1.30 | ○ | — | | 0.001 | ○ | 0.005 | ○ | 0.023 | X | — | |
| | 2 | 1.40 | ○ | 1.22 | ○ | — | | | | 0.001 | ○ | 0.025 | X | — | | | |
| | 3 | 1.38 | ○ | 1.35 | ○ | 1.50 | ○ | 1.60 | ○ | 0.001 | ○ | 0.001 | ○ | 0.009 | ○ | 0.015 | X |
| | 4 | 1.43 | ○ | 1.20 | ○ | 1.32 | ○ | 1.15 | X | 0.003 | ○ | 0.000 | ○ | 0.002 | ○ | 0.001 | ○ |
| | 5 | 1.41 | ○ | 1.15 | X | — | | | | 0.003 | ○ | 0.015 | X | — | | | |

| | | CHARGED AMOUNT(μC/g) | | | |
|---|---|---|---|---|---|
| | | INITIAL IMAGE (1st SHEET) | LOW DENSITY PRINTED IMAGE (3000th SHEET) | HIGH DENSITY PRINTED IMAGE (4000th SHEET) | DURABLE PRINTED IMAGE |
| EXAMPLES | 1 | 16.0 | 21.0 | 15.0 | 12.0 |
| | 2 | 13.0 | 17.0 | 13.0 | 11.5 |
| | 3 | 19.0 | 23.0 | 17.5 | 12.5 |
| | 4 | 14.0 | 18.0 | 17.3 | 11.7 |
| | 5 | 14.0 | 20.0 | 14.0 | 11.5 |
| | 6 | 14.0 | 22.0 | 16.0 | 12.5 |
| | 7 | 15.5 | 19.5 | 15.5 | 12.5 |
| | 8 | 16.5 | 22.0 | 16.0 | 13.0 |
| COMPARATIVE EXAMPLES | 1 | 16.0 | 18.0 | 12.5 | — |
| | 2 | 16.0 | 25.0 | — | |
| | 3 | 16.0 | 17.0 | 12.0 | 9.0 |
| | 4 | 16.0 | 25.0 | 17.5 | 22.0 |
| | 5 | 22.0 | 27.0 | — | |

As evident from Table 1 and Table 2, when B/A is more than 0.7 and is less than 0.96 (Examples 1 to 8), in comparison to the cases when B/A is 0.7 or less (Comparative Example 1 and Comparative Example 3) and when B/A is 0.96 or more (Comparative Example 2, Comparative Example 4, and Comparative Example 5), it was confirmed that, even when image formation is performed over a long period of time, it is possible to form high quality images with high image density and in which the charged amount of the toner will not deteriorate easily and the generation of fogging and the like can be inhibited.

According to the present disclosure, it is possible to provide an image forming apparatus in which the charged amount of the toner will not decrease even when image formation is performed over a long period of time, and capable of forming high quality images by inhibiting the generation of fogging and the like.

This application is based on Japanese Patent application No. 2010-205685 filed in Japan Patent Office on Sep. 14, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter.

What is claimed is:

1. An image forming apparatus, comprising:

a developer tank that houses a two-component developer containing toner and carrier; and a supply unit that supplies the developer tank with supply developer containing toner and carrier, wherein the toner contained in the two-component developer contains toner mother particles, and inorganic fine particles that are externally added to the toner mother particles, the toner contained in the supply developer contains toner mother particles, and inorganic fine particles that are externally added to the toner mother particles, the inorganic fine particles are silicon dioxide particles, the toner contained in the two-component developer is the same as the toner contained in the supply developer, the carrier contained in the two-component developer is identical to the carrier contained in the supply developer with respect to composition, but has been treated to have a rougher surface, and wherein, when the ratio of mass of inorganic fine particles attached to the carrier contained in the two-component developer to mass of the carrier contained in the two-component developer is A, and the ratio of mass of inorganic fine particles attached to the carrier contained in the supply developer to mass of the carrier contained in the supply developer is B, the following Formula (I) is satisfied:

$$0.7<B/A<0.96 \quad (1).$$

2. The image forming apparatus according to claim 1, wherein the inorganic fine particles attached to the carrier contained in the two-component developer are formed by the transfer of the inorganic fine particles contained in the toner in the two-component developer to the carrier, and the inorganic fine particles attached to the carrier contained in the supply developer are formed by the transfer of the inorganic fine particles contained in the toner in the supply developer to the carrier.

3. The image forming apparatus according to claim 1, wherein the content of the carrier in the supply developer is 1 to 20 parts by mass relative to 100 parts by mass of the toner.

* * * * *